US005144826A

United States Patent [19]

Morita

[11] Patent Number: 5,144,826

[45] Date of Patent: Sep. 8, 1992

[54] FORMING DEVICE TO BE PRACTICED IN COIL SPRING FORMING MACHINE AND METHOD OF REPLACING SAID DEVICE

[75] Inventor: Motoo Morita, Komaki, Japan

[73] Assignee: Morita Iron Works Co., Ltd., Aichi, Japan

[21] Appl. No.: 550,165

[22] Filed: Jul. 9, 1990

[51] Int. Cl.[5] ..... B21F 3/02

[52] U.S. Cl. ..... 72/140; 72/142

[58] Field of Search ..... 72/140, 142, 135, 134, 72/137, 455, 450

[56] References Cited

U.S. PATENT DOCUMENTS

| | | | |
|---|---|---|---|
| 2,018,209 | 10/1935 | Gogan | 72/142 |
| 2,038,488 | 4/1936 | Gogan | 72/142 |
| 2,165,411 | 7/1939 | Peyton | 72/142 |
| 3,000,427 | 9/1961 | Gogan | 72/142 |
| 3,225,579 | 12/1965 | Chambers | 72/142 |
| 3,753,363 | 8/1973 | Trihey | 72/140 |
| 4,644,773 | 2/1987 | Durr | 72/142 |

*Primary Examiner*—Lowell A. Larson
*Assistant Examiner*—Michael J. McKeon
*Attorney, Agent, or Firm*—Koda and Androlia

[57] ABSTRACT

A forming device in a coil spring forming machine for forming a coil spring by winding a heated rod or wire-shaped spring material into a form of a spiral, wherein the forming machine includes an independent cassette mechanism which may be removably mounted to a predetermined site on the body of the forming machine and the independent cassette mechanism is composed of a mandrel around which the rod or wire-shaped spring material is to be wound into a form of a spiral and a guide means for guiding the spring material in a direction along which the spring material may be wound around the mandrel at a required lead angle into a form of a spiral.

3 Claims, 19 Drawing Sheets

FORMING DEVICE TO BE PRACTICED IN COIL SPRING FORMING MACHINE AND METHOD OF REPLACING SAID DEVICE

BACKGROUND OF THE INVENTION

This invention relates to a forming device to be practiced in a coil spring forming machine and a method of replacing said device, more particularly to a constitution in the forming machine for forming a coil spring by winding a heated rod or wire-shaped spring material (spring material), wherein a cassette mechanism, composed of a major section which performs wind-forming corresponding to the desired type of spring as a single holder unit is removable from the body of the forming machine, and to a method of replacing said cassette, wherein an appropriate type of such cassette mechanism can be selected for respective requirements for forming the desired spring, and replaced therewith.

In a prior art equipment for forming coil springs, provided are a feeding machine for feeding and guiding horizontally a spring material freshly removed from a heating furnace through and along each roller, and also a forming machine disposed in a direction perpendicular to the forwarding end of said feeding machine, in which said material is wound around a mandrel while it is guided by a lead screw to determine the pitch of the resulting spring. When a spring is formed by use of such equipment, said equipment may have an embodiment essentially as shown schematically in FIG. 20. To describe in detail, said spring material is forwarded to a predetermined position by the feeding machine; the starting end (head end) of said material W is then brought to be in alignment with the starting end of the lead groove 60*a* of the lead screw 59*a* in the forming machine and simultaneously positioned by the chucking piece 103*a* of a chucking device disposed at the starting end of the mandrel 50*a* to be fixed thereby; thereafter the material W is serially wound to be formed into a spiral while it is guided by the synchronous rotation of the mandrel 50*a* and the lead screw 59*a* which are driven by a driving device 17*a* disposed in the forming machine, to determine the pitch; and finally the tail end portion of the material (end of the spring seat) is wind-regulated by a tail end regulating device 115*a*.

After completion of this winding operation, the starting end of the coil spring thus formed is released from the chucking device, and then the coil spring is removed from the mandrel relative to the movement of the mandrel when it is once removed from the forming machine from the side of the support of said machine by retracting it in the axial direction thereof. Said mandrel is advanced again to be reset at the predetermined position in the side of the support of the machine, whereby preparation for another cycle of spring forming is completed.

Thereafter, the process comprising the steps of feeding and winding the material, forming a spring and removing it will be repeated as described above.

PRIOR ARTS

In such an equipment for forming a coil spring according to any prior art as described above, extremely complicated operations for preparation and adjustment are required mainly in the forming machine each time when production of a different lot of the desired spring is started, since the major forming section needed for the wind-forming of the coil spring, i.e. the mandrel, lead screw, chucking device, tail end regulating device, etc. described above are all disposed individually at the respective position on the support of the forming machine, whereby a number of problems have been brought about in relation to such inconveniences. Namely, coil springs can be classified into several types in terms of the shape depending of the application, and they come in a great number of sizes if they are of the same type in terms of the shape (for example, in specifications such as in diameter, number of winding, pitch, size of the material, etc.).

Accordingly, said mandrel and lead screw must be selected corresponding to the type and the size of the spring to be produced, in view of diameter and length of the mandrel, pitch and shape of the lead groove, etc., respectively, and they are replaced each time when necessary. Moreover, the above procedure further involves changes in the rotation transmitting mechanism for the mandrel and lead screw relative to said driving device, even further replacement or frequent adjustment in said chucking device, the tail end regulating device, other auxiliary devices, and the like each time when necessary. Still worse, trial winding must be repeated many times to perform fine adjustment until the desired shape and size conforming to the spring to be produced can be achieved. Thus, under such circumstances, in fact it takes considerable labor and time even for a well-trained operator to achieve the preparation for such changes and adjusting operation, and thus the entire equipment is quite inefficient since the operability thereof is extremely limited.

Further, in said constitutional section for conducting forming, if they are diassembled once and then reassembled with the same members and under the same condition, it is difficult to achieve the original accuracy even with minute adjustment. Namely, if an operation of forming one type of spring is terminated and said constitutional forming section is replaced with another set for the purpose of forming another type of spring, considerable error will be generated in the constitutional forming section when the original set of constitutional forming section is set again, and thus it will be extremely difficult to form the first type of spring accurately. Accordingly, the range of ability for forming springs and universality of one set of spring forming equipment will actually be limited generally.

Moreover, since the operations of changing, replacement and adjustment for the constitutional forming section is conducted in said forming machine, around which said feeding/guiding machine and devices for processing springs are disposed, working space will be considerably limited, whereby it will be difficult for a plurality of operators to bring in various devices and parts for replacement for carrying out the necessary operation smoothly and safely in such limited space. On the other hand, said heating furnace involves problems such as waste of fuel etc., since it takes much time to regain a predetermined high temperature if said furnace is once cooled, and thus the inside of said furnace must be kept under heating to maintain the predetermined temperature even during the operation of replacing said main constitutional forming section.

SUMMARY OF THE INVENTION

This invention is novel one proposed to overcome the problems in the prior arts mentioned above. One aspect of this invention is a replaceable cassette type forming device composed of a holder as a cassette mechanism, which can be selected appropriately to conform to the desired type of spring, to be replaceably mounted to the support of the forming machine, comprising a mandrel, a lead screw, a rotation transmitting mechanism, a chucking mechanism, a tail end regulating device and other necessary auxiliary devices, means or members for constituting the major forming section positioned relative to each other; wherein it is intended to make handling and adjustment of the device itself simpler, to enable formation of various types of springs accurately by selecting freely a forming device which is comformable to the desired type of spring and replaced to be set in one common forming machine accurately, and to increase the range of forming capacity and universality.

Another aspect of this invention is a replacement method in which a large-scaled and complicated apparatus is not necessary for replacement when a cassette mechanism which is conformable to the desired spring is to be mounted, and the cassette device can be replaced speedily and safely by operators in an easy posture by means of a patterned operation and procedure; wherein it is intended to make the operation of forming springs more practical by saving labor and time required in the replacing and adjusting operation of the forming device and the trouble involved in trial winding, whereby to improve operability of the entire equipment for forming springs.

BRIEF DESCRIPTION OF THE DRAWINGS

FIGS. 1 to 19 each show an embodiment of this invention, wherein

FIG. 1 is a perspective view showing schematically the overall constitution of the equipment for forming springs;

FIG. 2 is an elevation showing schematically embodiments of the forming machine and the forming device;

FIG. 3 is a side sectional view showing schematically, the major section of the carriage device for replacing the mandrel along the line $Y_1$—$Y_1$ in FIG. 2;

FIG. 4 is an exploded perspective view showing schematically the major section in the operation system of the drive operation device;

FIG. 5 shows a cross-section of said major section in FIG. 4;

FIG. 6 is a front elevation showing the forming device partly in sections;

FIG. 7 shows a rear elevation of said forming device;

FIG. 8 is an exploded perspective view showing the major section of the forming device;

FIG. 9, 10 and 11 each show cross-sectional view of the forming device along the lines $Y_2$—$Y_2$, $Y_3$—$Y_3$ and $Y_4$—$Y_4$, in FIG. 6, respectively;

FIG. 12 shows a partially cut-away side view along the line $Y_5$—$Y_5$ in FIG. 6;

FIG. 13 is a partly omitted front elevation of the mandrel showing partly in sections;

FIG. 14 is a partly omitted front elevation of the lead screw showing partly in sections;

FIG. 15 is a front view of the replacing station showing schematically in section;

FIG. 16 shows the plan view of said replacing station;

FIGS. 17(*a*) and (*b*) each are illustrations showing stepwise the process of replacing the forming device (carrying in and carrying out);

FIG. 18 is a schematic front elevation of a different type of forming device;

FIG. 19 is a front elevation of another forming device to be practiced in said forming machine partly in sections;

EXAMPLE

The forming device to be practiced in the coil spring forming machine according to this invention and the method of replacing said device will be described by way of preferred embodiments referring to attached drawings. The equipment for forming springs to be illustrated by this embodiment has an overall constitution as shown schematically in FIG. 1. In such an equipment, while various cassette type forming devices (also referred to as cassette mechanisms) according to this embodiment are stored in a storage D provided outside of the forming machine A, more than one cassette mechanisms of different types to be used in the following order are preliminarily held and waiting on a replacing station C disposed adjacent to the outer end of said forming machine A. Through this replacing station C, forming devices B which are conformable to said forming machine A will be carried in or carried out for replacement. For convenience, detailed description will be made in the order of forming machine A, cassette type forming device B, replacing station C and examples of replacing method.

Figure 2:
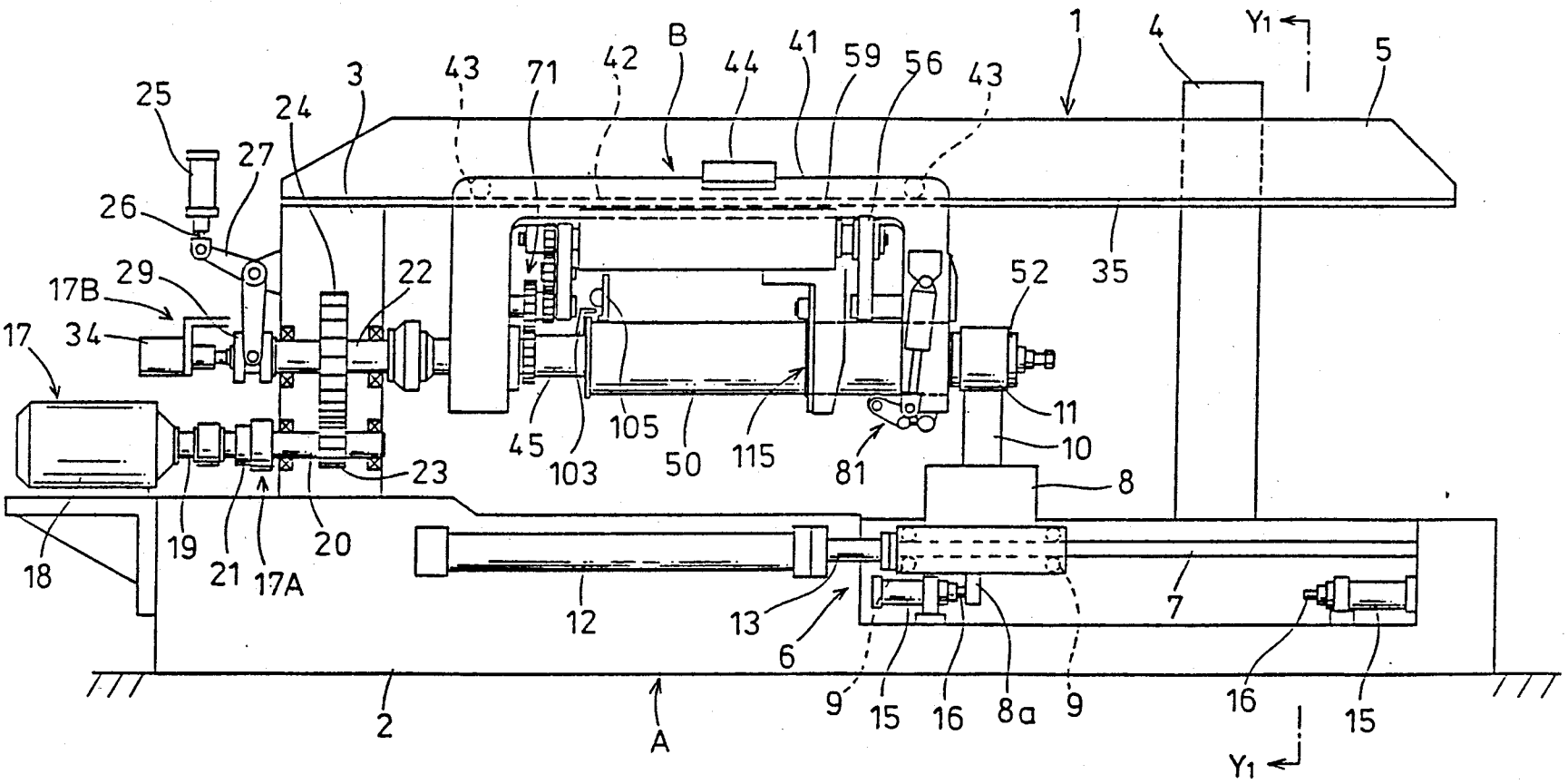
Figure 3:
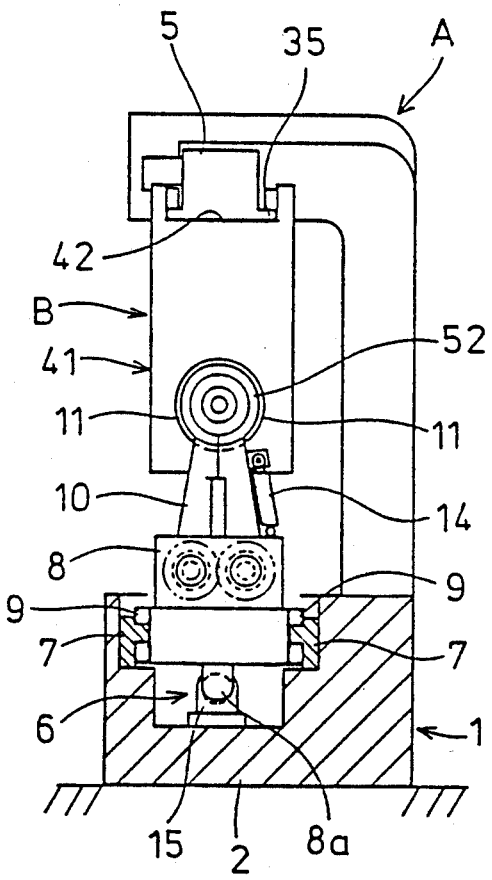

A forming machine A of a type whose entire constitution is shown schematically in FIGS. 2 and 3 will be first described briefly. In said forming machine A, a beam 5 is extended parallel with the base 2 between a frame 3 and a strut 4 each stand at the left and right end of the base 2, and the entire forming machine body 1 is formed into an elongated (widthwise in terms of the above Figures) rectangular frame, to which the cassette type forming device B can be inserted or it can be removed from the right side of the body 1 as shown in the above Figures. In the base 2, a movable support device for replacement (carriage device) 6, and in the frame 3 in the left side of the body 1, a drive operation device 17 are disposed, respectively; further in the beam 5, a guide rail 35 is provided.

Said carriage device 6 is intended for the operation of replacing the forming device B by supporting the latter thereon, and provided with a traveling pedestal 8 which is reciprocatable by means of wheels 9 relative to rails 7 disposed horizontally within said base 2; a pair of bearing arms 10 standing on said traveling pedestal 8 and pivotally supported thereon, which arms being interlocked to allow opening or closing thereof; and an operating cylinder 12 provided in the base 2 in the longitudinal direction as shown in Figures; wherein the tip end of a rod 13 of said cylinder 12 being connected to the traveling pedestal 8; respective semicircular bearing pieces 11 of the two bearing arms 10 supporting a mandrel 50, at the right end, in the forming device B to be described later; and the forming device B thus being removable when carried by the traveling pedestal 8 along the rails 7 to a predetermined position through the reciprocating motion of the cylinder 12. The both bearing arms 10 are interlocked by means of a gear or the like at the fulcrum for slanting said arms relative to the traveling pedestal 8, and the arms 10 will be turned to the directions opposing to each other (to the left and right in FIG. 3) to be closed or open upon actuation of a closing cylinder 14 which is connected to one of the arms. The numeral 15 shows a pair of shock absorbers disposed within the base 2 at both end portions, each being adopted to moderate shock of said traveling pedestal 8 or absorb it when each rod 16 projecting toward each other is abutted with a projection 8*a* protruding downward from said traveling pedestal.

On the other hand, in the drive operation device 17, provided are a rotation system 17A intended for the mandrel 50 and an operation system 17B intended for a chucking device 97 to be described later, as shown schematically in FIG. 2; and in the rotation system 17A, a drive shaft 20 equipped with a brake extended longitudinally and supported rotatably below the frame 3 is connected to the shaft 19 of a motor 18 through a coupling 21, and the drive shaft 20 and a rotary main shaft 22 in the form of a hollow shaft having a circular bore rotatably supported horizontally through the middle of the frame 3 are usually interlocked through gears 23 and 24. As for the operation system 17B, while the rod 26 in an operating cylinder 25 provided outside of the frame 3 is connected to a horizontal piece of an L-shaped lever disposed on the left side surface of the frame 3, an operating rod 28 inserted through the rotary main shaft 22 in the axial direction thereof is connected to a vertical piece of the lever 27 through a linking member 29. When the operating rod 28 is pushed to the right through the lever 27 upon actuation of said cylinder 25, the tip end (the right end portion in FIG. 6) of said rod 28 is allowed to project from the end of the rotary main shaft 22 by an appropriate length whereby to allow unchucking operation of a chucking device 97 to be described later.

Figure 4:
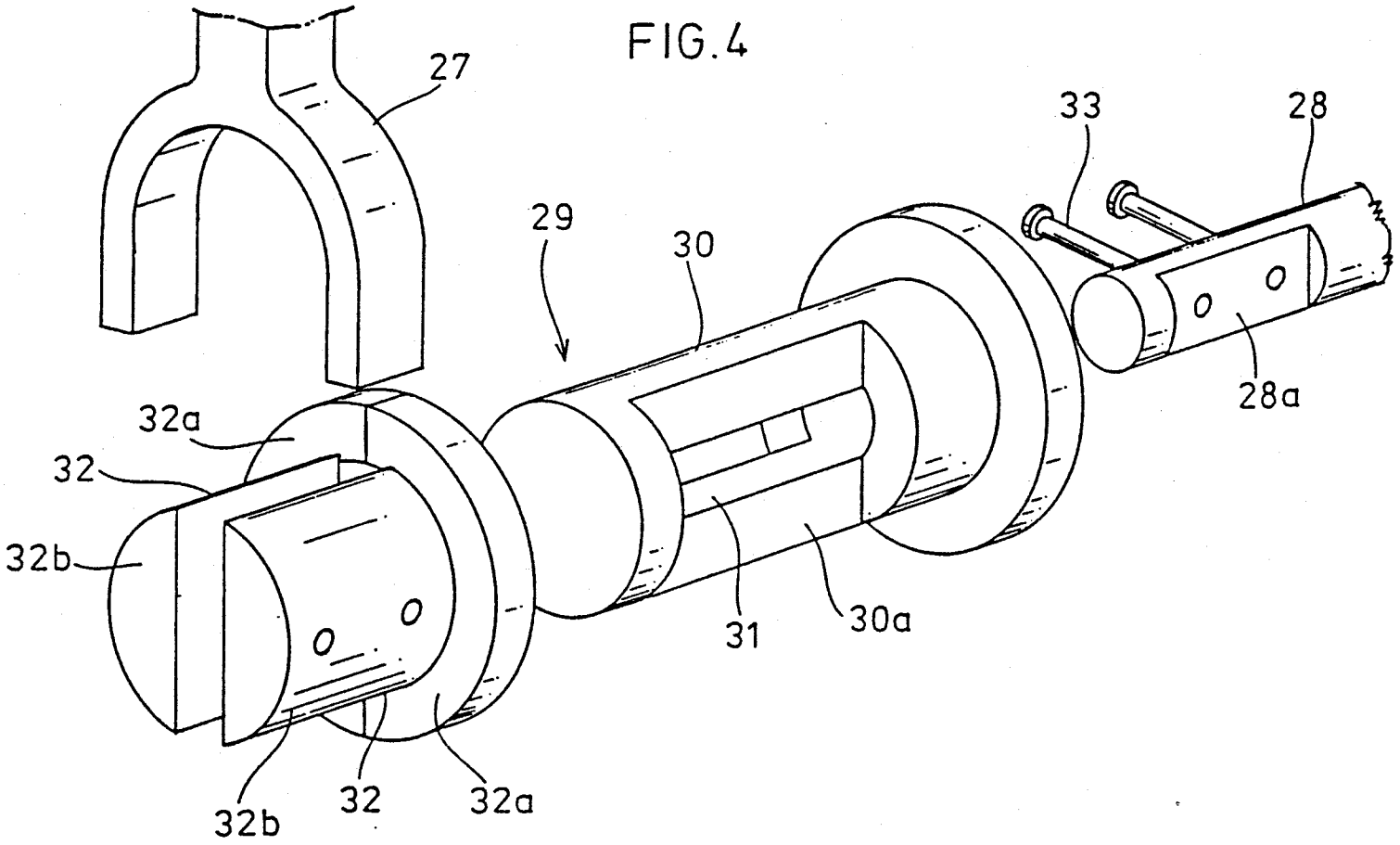
Figure 5:
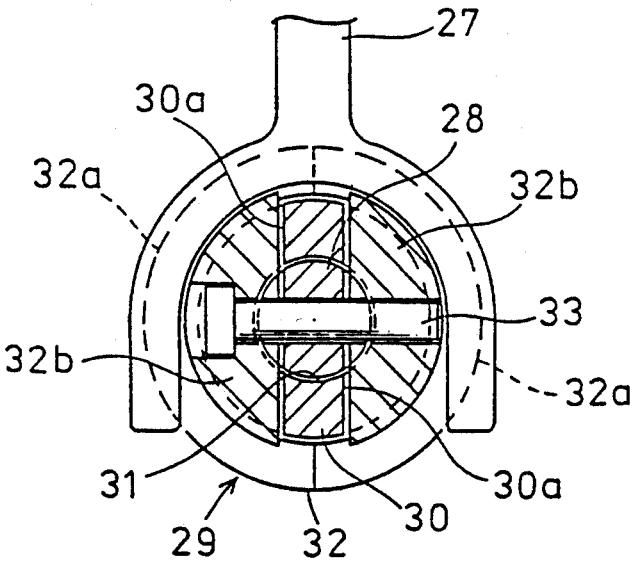

The linking member 29, as shown in FIGS. 4 and 5, is provided with a support cylinder 30 having the rear end portion of the operating rod 28 inserted therein, which member 29 is connected to the rear end of the rotary main shaft 22 by means of a bolt or the like; and a pair of connecting members 32 which together form a cylindrical configuration (semicylindrical connecting members) and are fitted slidably in fitting portions 30*a* provided on both sides of said cylinder 30. The connecting shaft portions 28*a* of the operating rod 28 and the connecting pieces 32*b* of the semicylindrical connecting members 32 are combined by means of pins 33 to penetrate radially through the shaft bore 31 of the cylinder 30, whereby the vertical piece of the lever 27 can be abutted directly with flanges 32*a* at the semicylindrical connecting members 32. Thus, the operating rod 28 and the semicylindrical connecting members 32 are rotatable with the rotation of the cylinder 30, and also they are allowed for shifting in the axial direction of the cylinder 30. It should be noted that the semicylindrical connecting members 32 each comprise an approximately semicircular flange 32*a* having a diameter larger than that of the cylinder 30 formed integrally with a semicylindrical connecting piece 32*b* having a diameter which is approximately the same as that of the cylinder 30, and are fit to the fitting portions 30*a* provided on both sides of the cylinder 30 to be combined into an assembly. The numeral 34 shows a rotation detector provided to oppose the cylinder 30, which detects the rotation of the rotary main shaft 22 and in turn of the mandrel 50.

The guide rail 35 in the machine body 1 is intended for guiding the cassette type forming device B by supporting the latter to be suspended therefrom so that said device B can travel therealong, and is formed horizontally in the longitudinal direction along the lower surface of the beam 5. The right end of said rail 35 assumes a free end extending from the strut 4 in the form of eaves. However, the rail 35 and the beam 5 may be formed of a single member.

Next, the cassette type forming device B will be described in detail. Said device B, as shown in FIGS. 6 to 12, comprises a holder 41, as the cassette body, which is movable along the guide rail 35 in said forming machine A, wherein a mandrel 50 and a lead screw 59 both of which have been preliminarily set, supporting means therefor, rotation transmitting means and various necessary auxiliary devices are assembled, and the entire assembly can be handled as a cassette. To describe in detail, said holder 41 has a U-shaped frame (in elevation) comprising an upper arm 41*a*, left and right side arms 41*b* and 41*c*. Said holder 41 is supported in rail grooves 42 provided in the guide rail 35 along the longitudinal direction of the upper surface of the upper arm 41*a*, through wheels 43 disposed in said rail groove 42 at both end portions, to be suspended from said rail, and is also fixed at a predetermined position by means of a clamp 44 provided in the middle of the upper arm 41*a*.

Figure 6:
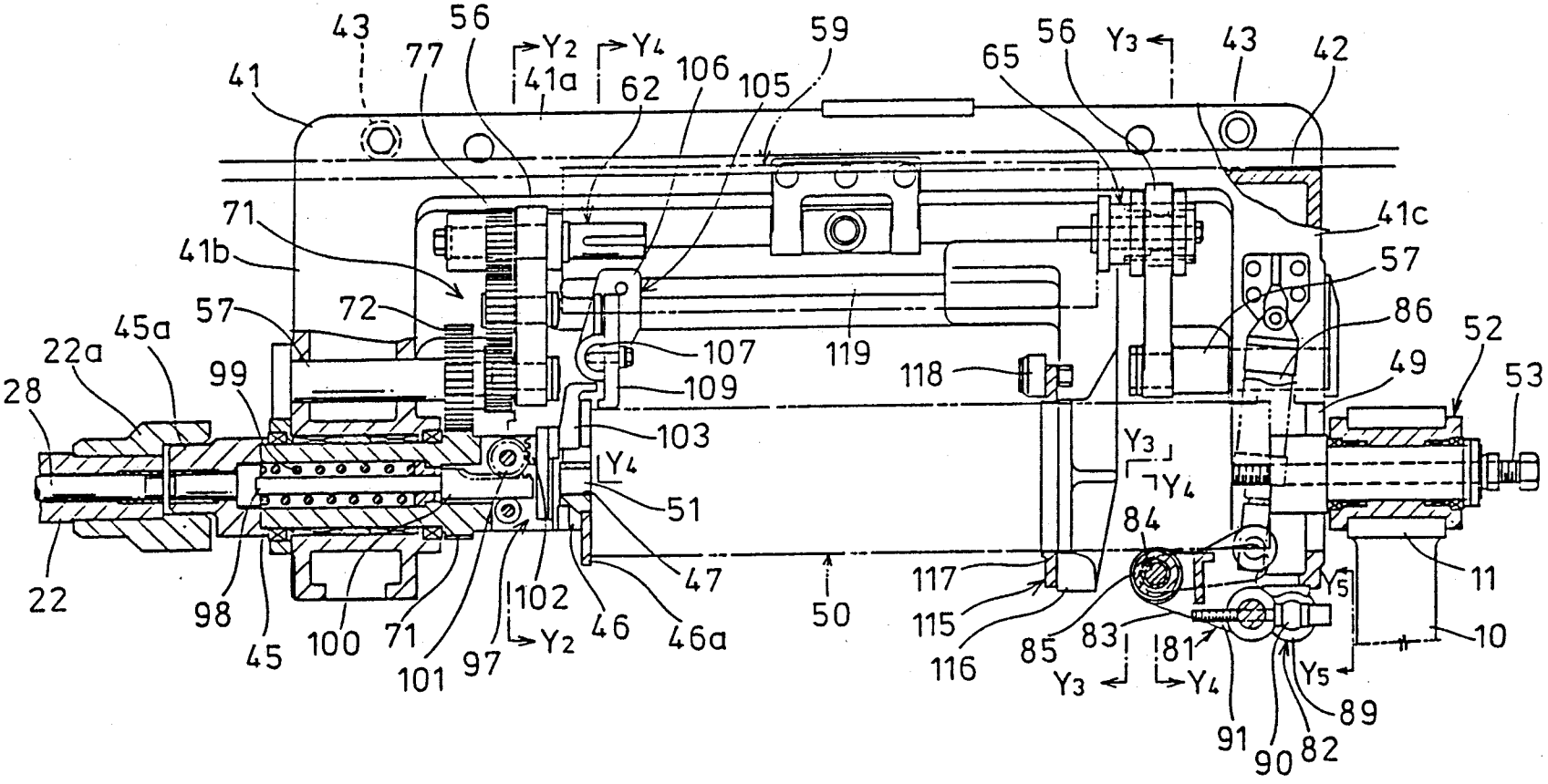

In the above holder 41, a rotary support shaft 45, as a means for supporting the mandrel 50, is rotatably supported horizontally through the left side arm 41*b* in the lower portion, wherein said shaft being connected to the rotation system 17A of the drive operation device 17; and an insertion opening 49 being formed in the lower portion of the right side arm 41*c*; said rotary support shaft 45 and said opening 49 being in alignment with each other along the horizontal central line. Said rotary support shaft 45 is formed into a hollow shaft having a circular bore and intended for providing rotation for the mandrel 50 by supporting one end (left end in FIG. 6) of said mandrel 50 and connecting it to the drive operation system 17A. One end (left end in FIG. 6) of said shaft 45 is designed to be removably linked to said rotary main shaft 22 through their respective couplings 22*a* and 45*a*, as shown in FIG. 6. A seat 46 having a support flange 46*a* of a diameter suitably larger than that of the mandrel 50 is fixed to the other end (right end in FIG. 6) of said support shaft 45 by means of bolts or the like. The couplings 22*a* and 45*a* are both designed to be engaged with each other with the square-shaped fitting recess and protrusion. The seat 46 is also intended to serve as a holder for a chucking piece 103 of the chucking device 97 to be described later, and can be replaced with any ones each are conformable to mandrels having different diameters, respectively; wherein an engagement hole 47 is formed at the center, and also a slit 48 for holding the chucking piece 103 is formed radially. Said insertion opening 49 has a circular cross-section with a diameter which permits passage of the mandrel of the maximum size to be usable in said forming device B.

Figure 7:
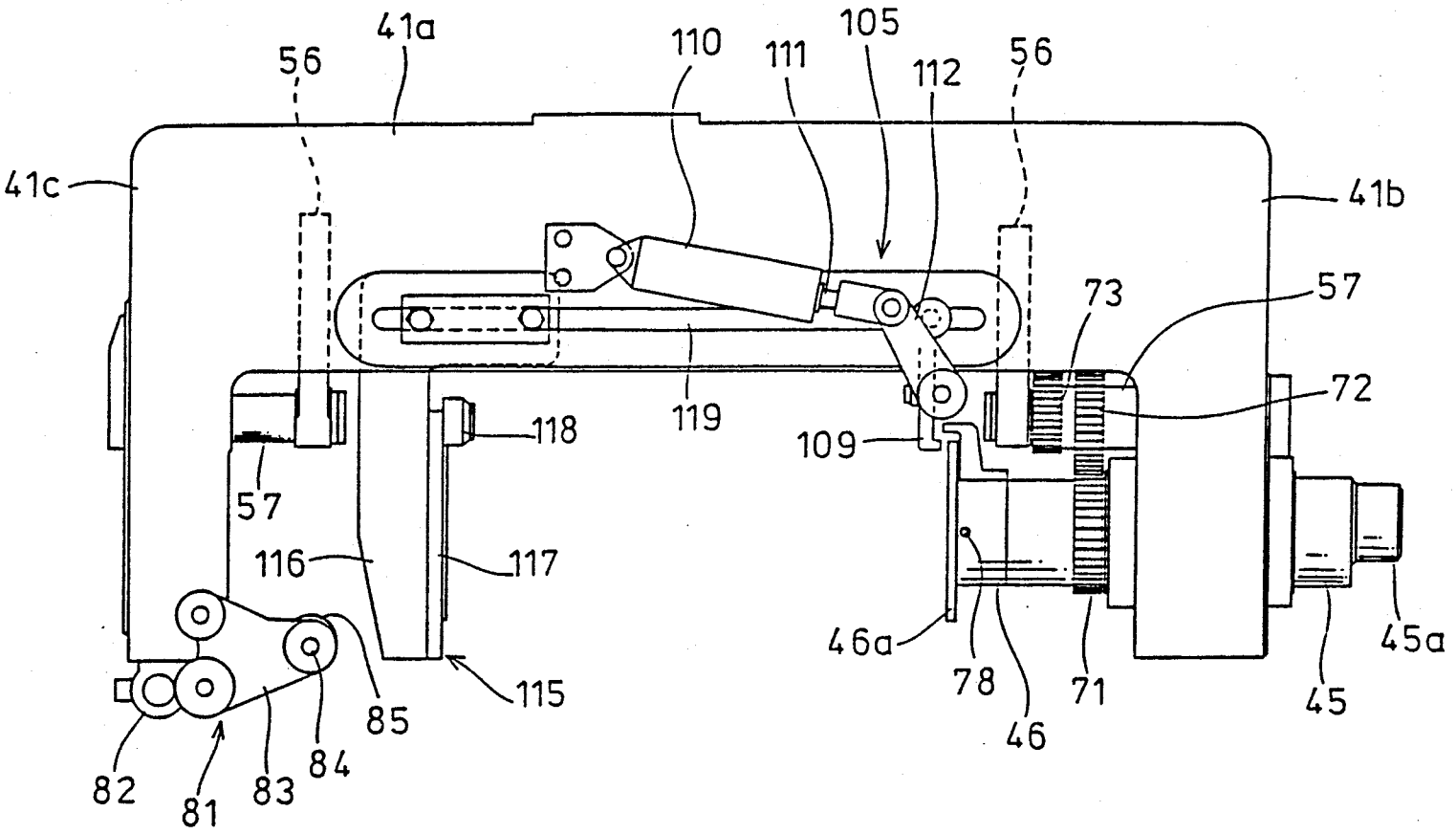
Figure 8:
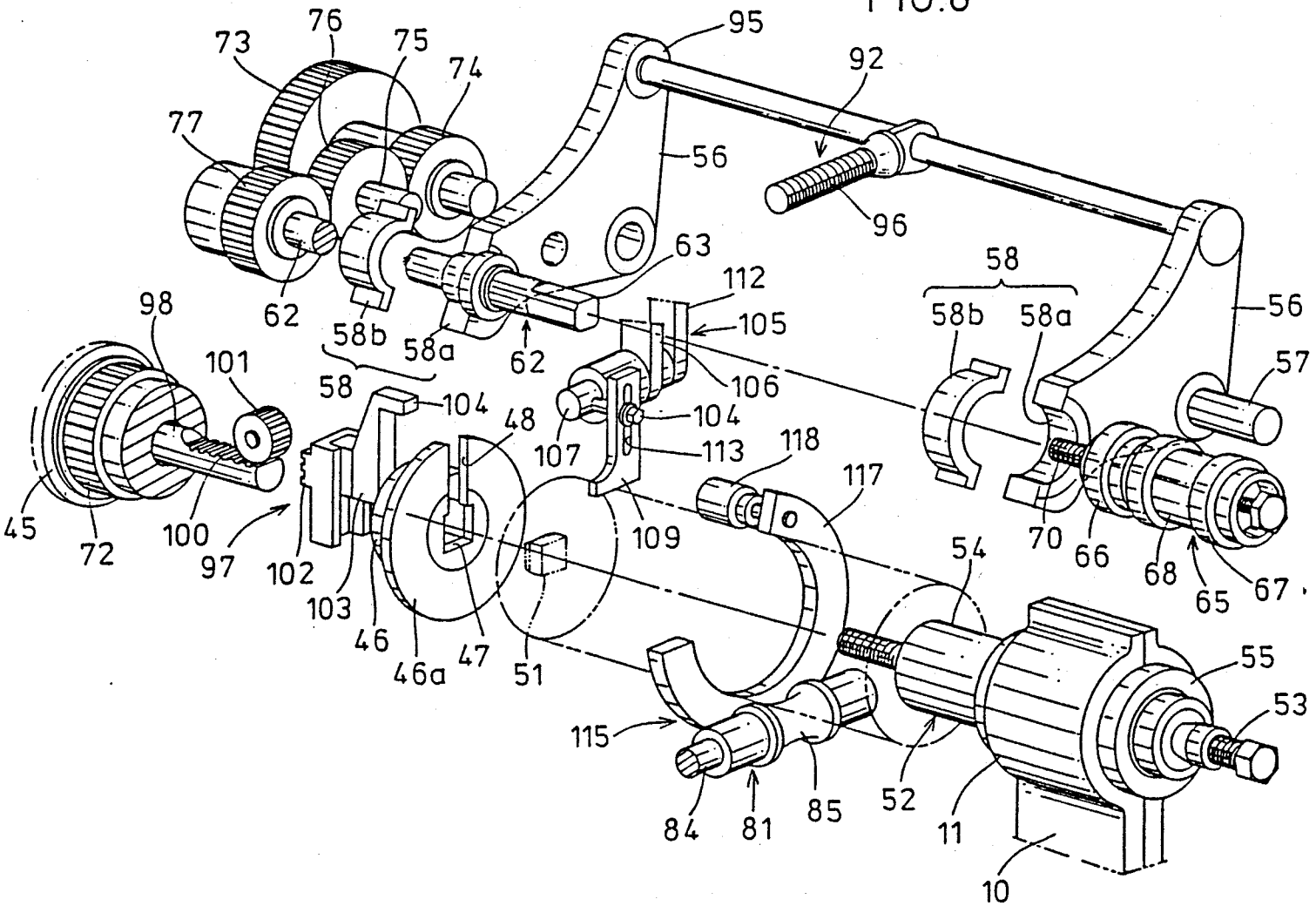
Figure 10:
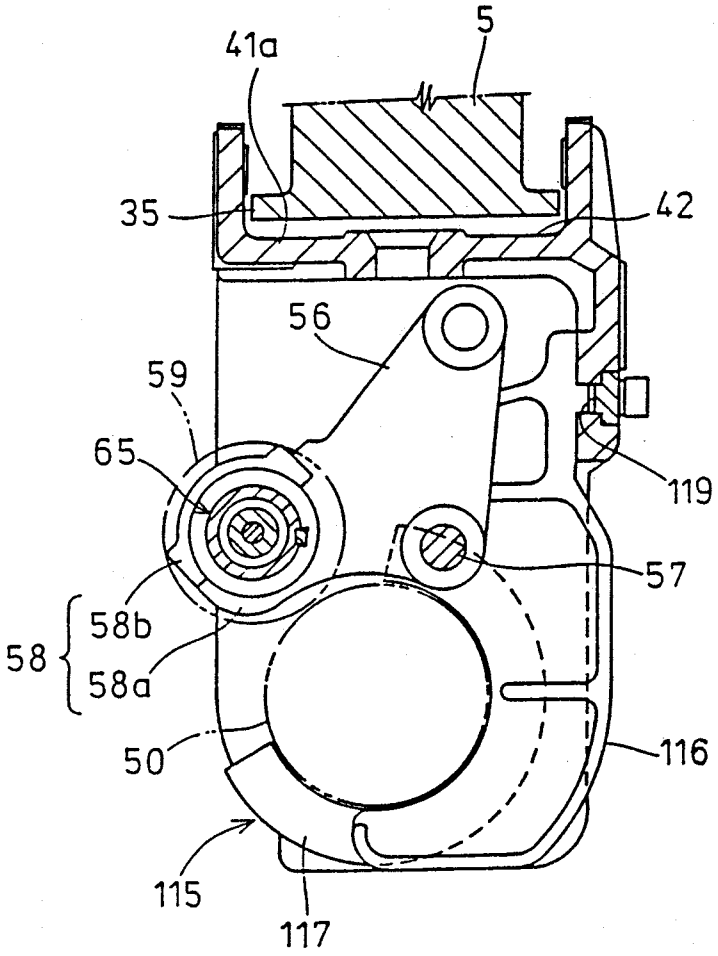
Figure 13:
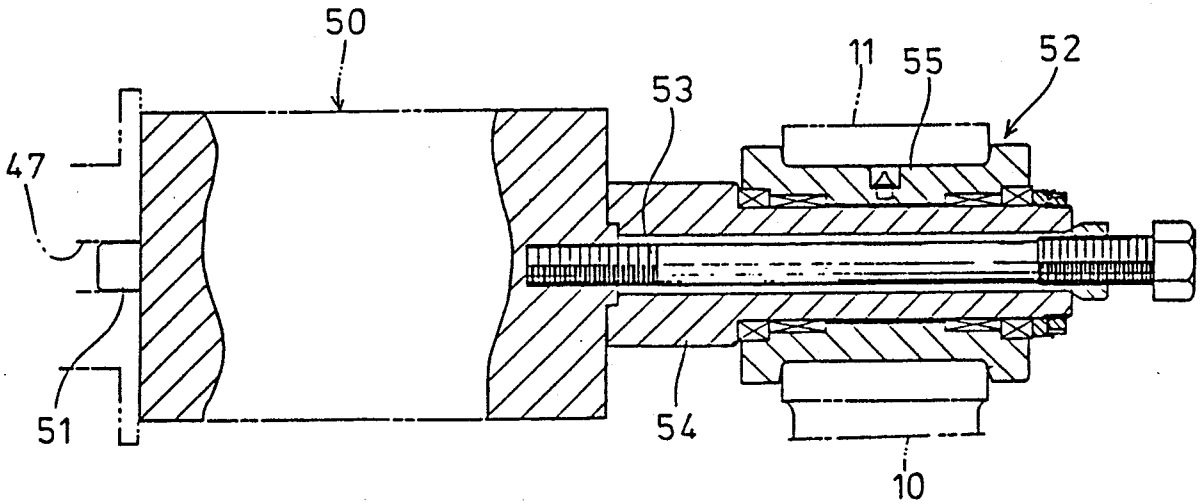

In said forming device B, the mandrel 50 can be selected from various types to be used therein. Although the mandrels 50 may have different diameters within a predetermined range following the requirements for forming particular springs, they should have a common constitution and a constant length. As shown in FIG. 13, an engaging boss 51 protrudes from the center of one end of the mandrel 50, and a shaft support member 52 is fixed to the center of the other end by means of a bolt 53. When the mandrel 50 is not under operation, the engaging boss 51 thereof is positioned in the engagement hole 47 provided in said rotary support shaft 45 and is fitted therein; and the other end stays in the insertion hole 49 of said holder 41 to be retained therein as a provisional assembly; whereas when said mandrel 50 is under operation, the engaging boss 51 is linked to the seat 46 of the rotary support shaft 45 and fixed by means of a set screw 78 in said seat 46 or by other means, and the shaft support member 52 is supported between the bearing pieces 11 of the two bearing arms 10 in said carriage device 6, whereby the mandrel 50 is aligned horizontally between the rotary support shaft 45 and the bearing arms 10, respectively, and connected thereto, as shown in FIGS. 6 to 8.

It should be noted in the above embodiment, the entire forming device B can travel along the guide rail 35 in the forming machine A by the horizontal movement of the arms 10 along with the traveling pedestal 8 on the carriage device 6; and the mandrel 50 can be separated from the rotary support shaft 45 by moving the traveling pedestal 8 rightward after the linkage between said shaft 45 and the mandrel 50 is released, whereby the mandrel 50 can be removed horizontally out of the holder 41 through the insertion opening 49. However, the linkage between the mandrel 50 and the bearing arms 10 or separation thereof can also be attained by use of said bolt 53 which has been inserted into the shaft support member 52 and is to be screwed into the mandrel 50 by allowing said shaft support member 52 to be embraced between the both bearing pieces 11. In this connection, the shaft support member 52 consists of a support cylinder 54 to be fitted to the right end center of the mandrel 50 to be positioned and fixed there by means of the bolt 53, and a rotary sleeve 55 fitted over the external surface of the support cylinder 54 through bearings, which sleeve is to be embraced between the bearing pieces 11 of the two bearing arms 10, as shown in FIG. 13.

In said holder 41, a pair of support arms 56, as a means for supporting the lead screw, are pivotally disposed on the internal side of the left and right side arms **41*b* and 41*c* at symmetrical positions. The arms 56 both have an approximately L-shaped configuration as shown in FIGS. 6 to 10, and are fixed through the hinges provided in the middle part thereof to respective fulcrum shafts 57 fixed horizontally through the middle part of the side arms 41*b* and 41*c*, at inner end portions, respectively. At each horizontal free end of said L-shaped support arms 56, a bearing portion 58 is formed, respectively. Each arm 56 is also removably fitted to said fulcrum shaft 57. Each bearing portion 58 comprises a separable system, i.e. a semicircular holder section 58*a* and a semicircular covering piece 58*b*** which are fixed together by means of a bolt and the like.

Figure 14:
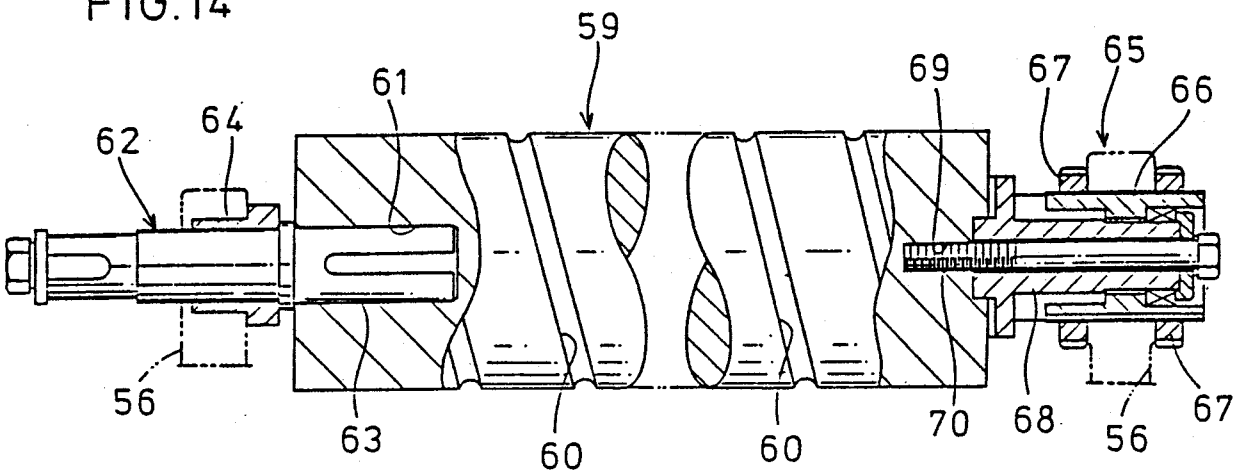

The lead screw 59 to be supported horizontally between said support arms 56 can also be selected appropriately from various types to be used in said forming device as in the case of the mandrel 50. Although the lead screws 59 may have different diameters or lead grooves 60 following the requirements for forming particular springs, they should have a common constitution and a constant length. As shown in FIG. 14, a first rotary support means 62 and a second rotary support means 65 are removably set at the center of both end portions of said screw 59. The lead screw 59, when normally set to said holder 41, is supported parallel with and above the mandrel 50, under the state where the rotary support means 62 and 65 are supported by being fitted in the bearing portions 58 of the support arms 56 at both ends.

Referring to said rotary support means, the first support means 62, shown at the left of FIGS. 8 and 14, has a form of single shaft in which an engaging shaft portion 63 to be removably fitted to the engagement hole 61 on the left end of the lead screw 59 is formed, and is designed to be inserted into the bearing portion 58 of said arm 56 through a sleeve 64. On the other hand, the second rotary support means 65 shown on the right in the Figures is composed of a support cylinder 66 to be retained by the bearing portion 58 of said arm 56 and fixed by clamp rings 67, wherein the position of said cylinder 66 to be supported by said bearing portion 58 being adjustable; a rotary cylinder 68 inserted in said support cylinder 66 to be retained thereby and fitted to the right end of the lead screw 59; and a bolt 70 inserted horizontally through said rotary cylinder 68 and embedded in a threaded hole 69 provided on the right end of the led screw 59, wherein said second rotary support member is also adopted to be removable (separable) from the lead screw 59 by use of the bolt 70.

The rotation transmitting mechanism 71 which transmits rotation of said lead screw 59 is composed of a series of gears provided with respect to said rotary support shaft 45, said left support arm 56 and the first rotary support means 62 as shown in FIGS. 6 to 8. To describe in detail, a first gear 72 formed on the inner end of the rotary support shaft 45, a second gear 73 fitted on said fulcrum shaft 57 and bearing the latter therein, a third gear 74 formed coaxial with said second gear 73, a fourth gear 76 fitted on the fulcrum shaft 75 fixed horizontally on one side of the support arm 56 and bearing the fulcrum shaft 75 therein, and fifth gear 77 fitted on the outer end of the first rotary support means 62 are engaged to one another, whereby the lead screw 59 is adopted to be rotated together with the first rotary support means 62 in the direction opposing to that of the mandrel which is rotated together with the rotary support shaft 45, in synchronization with said mandrel 50.

Various devices and other means or members to be disposed relative to the mandrel 50 and the lead screw 59 in the forming device B will be described below. First, a guide support device 81 for guiding the mandrel 50 when it is inserted or removed is provided in the right side arm **41*c* of the holder 41. Said device 81, as shown in FIGS. 6 to 8, is provided with an adjusting support member 82 disposed at the lower end of the side arm 41*c*; a movable frame 83 pivotally fixed to the lower portion of the side arm 41*c* and shiftably positioned relative to the adjusting support member 82 and retained there; a crank shaft 84 removably supported horizontally over the free end (left end in FIG. 6) of this movable frame 83; a roller 85 having a constricted cross-section in the middle portion thereof fitted on the eccentric shaft portion of the crank shaft 84; and an operating cylinder 86 pivotally fitted to the side arm 41*c*; wherein the lower end of the rod 87 of said cylinder 86 is connected to the end of the crank shaft 84 through an arm 88. With the actuation of the cylinder 86 for reciprocating motion, the rod 87 is allowed to move vertically, whereby as the crank shaft 84 is turned, the roller 85 is shifted by the amount corresponding to the amount of offset in the crank shaft 84 such that the roller 85 may be shifted to a guide support position at which the roller 85 can be abutted against the lower peripheral surface of the mandrel 50** or to a rest position at which said roller is spaced from the mandrel.

In the adjusting support member 82 in said guide support device 81, a pivotal shaft 90 is supported horizontally through a holder 89 fixed to the lower end of the right side arm 41*c*, and a bolt (tapped rod) 91 supported by said pivotal shaft 90 perpendicular to said pivotal shaft 90 and extends in the axial direction of the mandrel 50 is screwed into the middle part of the movable frame 83. As the slanting level of the entire movable frame 83 is changed by turning this bolt 91 to move in the negative or positive direction, the position of the roller 85 will in turn be adjusted in the diametral direction (vertical direction in FIG. 19) of the mandrel 50, whereby various types of mandrels having different diameters can be received at proper positions.

Figure 9:
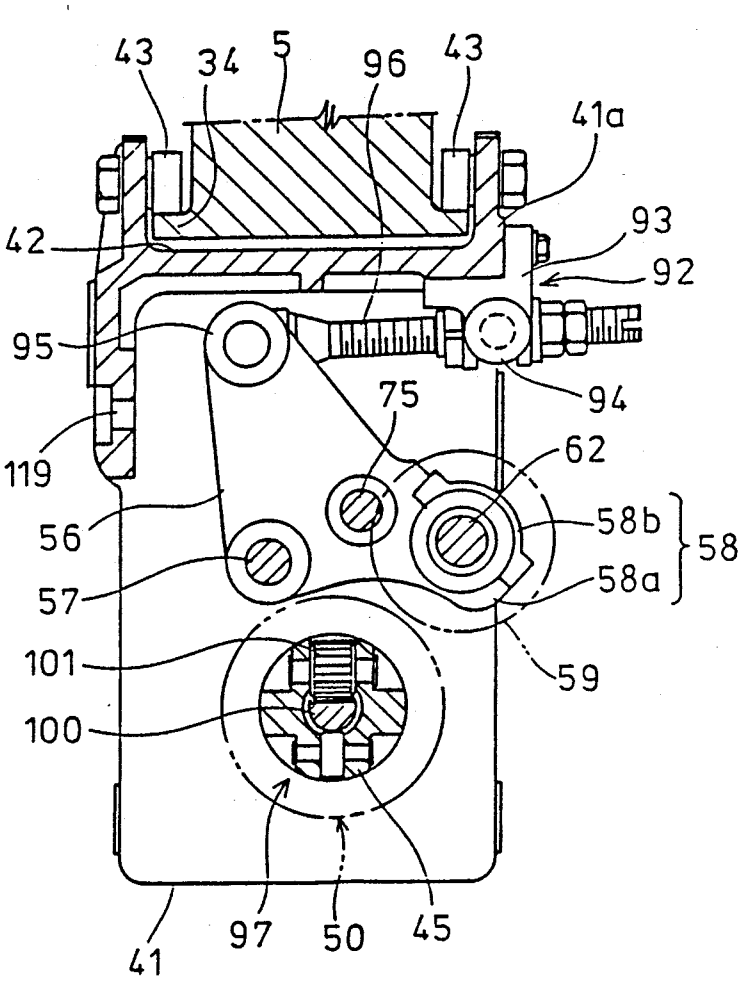
Figure 12:
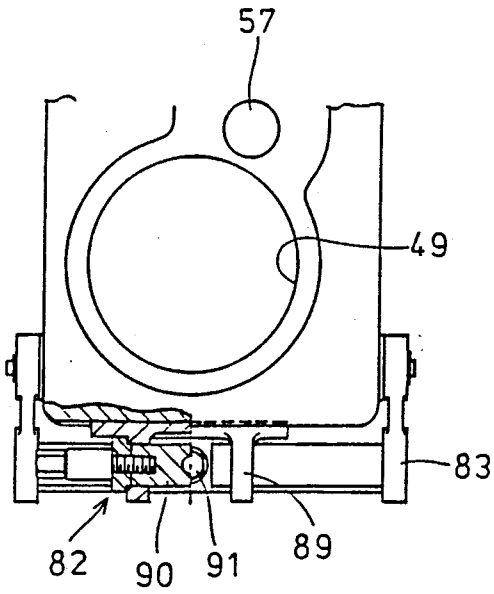
Figure 11:
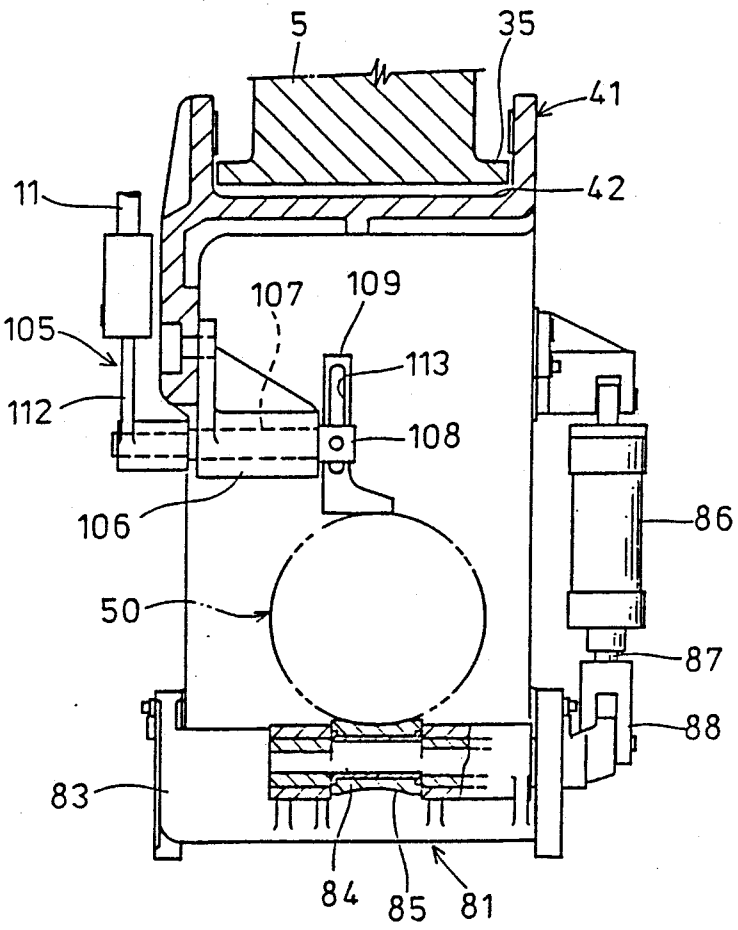

The adjusting device 92 for adjusting the position of the lead screw 59 relative to the mandrel 50 is linked to said left support arm 56. This device 92, as shown in FIGS. 8 and 9, is provided with a holding means 93 disposed on the front surface of the upper arm 41*a* of the holder 41; a bolt (tapped rod) 96 movably supported horizontally through an internally threaded pivotal cylinder 94 in the holding means 93 and linked to the linking portion 95 on the upper end of the vertical piece of the support arm 56, and by turning the bolt 96 to the required direction, the support arm 56 is tilted or turned clockwise or counterclockwise in terms of FIG. 9 around the fulcrum shaft 57 as the bolt 96 is shifted relative to said internally threaded pivotal cylinder 94, whereby the axial center position of the bearing portion 58 of said arm 56 can be shifted closer or farther relative to the mandrel 50. Thus, the lead screw 59, when it is replaced with another having a different diameter, can be set at a proper position with proper space relative to the mandrel 50, while it is supported between the two support arms 56. It should be noted that during the change in the level of tilt in the left support arm 56, the fourth gear 76 and the fifth gear 77 are retained in proper engagement with each other at constant radial positions relative to the third gear 74 on the fulcrum shaft 57, in said rotation transmitting mechanism 71.

As devices which participate in the wind-forming of a spring, there can first be mentioned the chucking device 97 for fixing the starting end of the spring material provided in said rotary support shaft 45. This device 97, as shown in FIGS. 6 to 8, is composed of an actuating rod 98 inserted through the rotary support shaft 45 and engaged in the coupling 22*a* by being urged constantly by a spring 99 toward the operating rod 28 in the drive operation device 17 in the line of the forming machine A to be abutted against said operating rod 28 (as shown in Figures); a pinion 101 which is retained in said support shaft 45 and engages with a first rack 100 formed on the tip end (right end in Figures) of the operating rod 98; a second rack 102 which is inserted vertically in the seat 46 in the radial direction thereof, and engages with the pinion 101; and a hook-shaped chucking piece 103 fixed to the second rack 102 and rising therefrom; wherein a press-holding portion 104 which can be inserted in the slit 48 in the seat 46 and has an effective length corresponding to the maximum diameter of the spring material is formed on the tip end (upper end in the Figures) of the chucking piece 103.

In this device 97, since said actuating rod 98 is urged by the spring 99, the chucking piece 103 usually locates at an open position, i.e. the chucking piece 103 is moved inward relative to the radial direction of the seat 46; whereas when the the actuating rod 98 is pushed together with the operating rod 28 as the operation cylinder 25 is operated, the chucking piece 103 is extended outwardly relative to the radial direction of the seat 46 through the rack 100, the pinion 101 and the rack 102 to assume a closed posture under which starting end of the spring material can be received. When the cylinder 25 is then returned to the original position, the chucking piece 103 returns to the original position by moving inward relative to the radial direction of said seat 46 with the aid of the spring to assume the open state, whereby the starting end of the spring material can be held tightly between the press-hold portion 104 and the peripheral surface of the mandrel 50. It should be noted that the second rack 102 and the chucking piece 103 are replaceable with those having different sizes.

The starting end regulating device 105 for regulating the starting end of the spring material to be at a position where it can be caught by the chucking piece 103 is provided on the left side of the holder 41. This device 105, as shown in FIGS. 6 to 8 and 11, is provided with a bracket 106 fixed to the internal side of the left extremity of the upper arm 41*a*; a pivotal support bar 107 inserted into the bearing portion of the bracket 106; an approximately L-shaped regulating bar 109 supported vertically by a holding means 108 on the inner end of said pivotal support bar 107; and an actuating cylinder 110 mounted on the back surface of the upper arm 41*a* such that it can be slanted, and the rod 111 of said cylinder 110 is linked to the other end of the pivotal support bar 107 through an arm 112. With the horizontal stretching motion of the rod 111 in accordance with the reciprocating motion of the cylinder 110, said regulating bar 109 is adopted to be shifted to a regulating position wherein said regulating bar 109 is contacted perpendicular to the peripheral surface of the mandrel 50 to oppose to the flange 46*a* of the rotary support shaft 45 or to a rest position wherein said bar 109 is slanted and retracted from the flange 46*a* and the mandrel 50 in accordance with the pivotal movement of the pivotal support bar and retained there.

In this device 105, since said regulating bar 109 is shiftable vertically relative to the holder 108 through a slot 113 and a bolt 114, said bar 109 can be fixed at predetermined positions at which it can be contacted with various mandrels 50 with different diameters, whereby regulation of the positioning of the starting end of the spring material can be achieved. It should be noted that as another application of said device 105 such as when the mandrel 50 has a relatively small diameter, or when the spring material has a small diameter, it is also possible to hold the starting end of the spring material tightly between said regulating bar 109 and said support flange 46*a* as an alternative of the starting end holding device for said chucking device 97. Also, as another application in removing the spring thus wind-formed, it is also possible to lock the starting end of the spring material, when the mandrel 50 is once separated from the rotary support shaft 45 and retracted, to allow easy removal of said spring.

Next, a tail end regulating device 115 for regulating the tail end portion of the spring material is disposed inside of the right side arm 41*c* of the holder 41. This device 115, as shown in FIGS. 6 to 8 and 10, is provided with a movable support bar 116 suspended from the upper arm 41*a* of the holder 41; a C ring-shaped regulating board 117 fixed on this movable support bar 116 and to be fitted over the peripheral surface of said mandrel 50; and a pressing member 118 in the form of roller provided on said regulating board 117; whereby the position of the wind end portion of the spring material, i.e. the spring seat end, is regulated by said regulating board 117; and the end portion of the spring material released from said lead screw 59 is pushed and guided by the pressing member 118 to allow the spring material to be applied around the peripheral surface of the mandrel 50.

In this device 115, in accordance with the change of the size (length, diameter, etc.) of the springs to be formed, said movable support bar 116 is adopted to be shiftable along the slot 119 formed along the longitudinal direction of the lower edge of the upper arm 41*a* of the holder 41 and fixable at a required position corresponding to the desired spring length. Said regulating board 117 is removably fixed to the support bar 116 and is replaceable with the ones which are conformable to the mandrels 50 with different diameters. The pressing member 118 is fixed at a required position of the regulating board 117, the position of which is changeable along the peripheral direction so that it can accept the end (spring seat) of various types of spring materials. It should be noted that the bracket 106 of the starting end regulating device 105 is shiftable along said slot 119.

Therefore, the respective forming devices B described above has a common constitution, wherein one end of a predetermined size of mandrel 50 held horizontally through said holder 41 is positioned relative to the rotary support shaft 45 and connected thereto; whereas a predetermined size of lead screw 59 is supported horizontally between the two support arms 56 through their rotary support means 62 and 65, and said screw 59 is also set at a predetermined position by means of the adjusting device 92 and linked to the rotary support shaft 45 through a rotation transmitting mechanism 71 having a required speed ratio. The guide support device 81, starting end regulating device 105, tail end regulating device 115, etc. are disposed at predetermined positions, respectively, and the entire constituents are formed into a cassette as a unit of holder 41.

Figure 15:
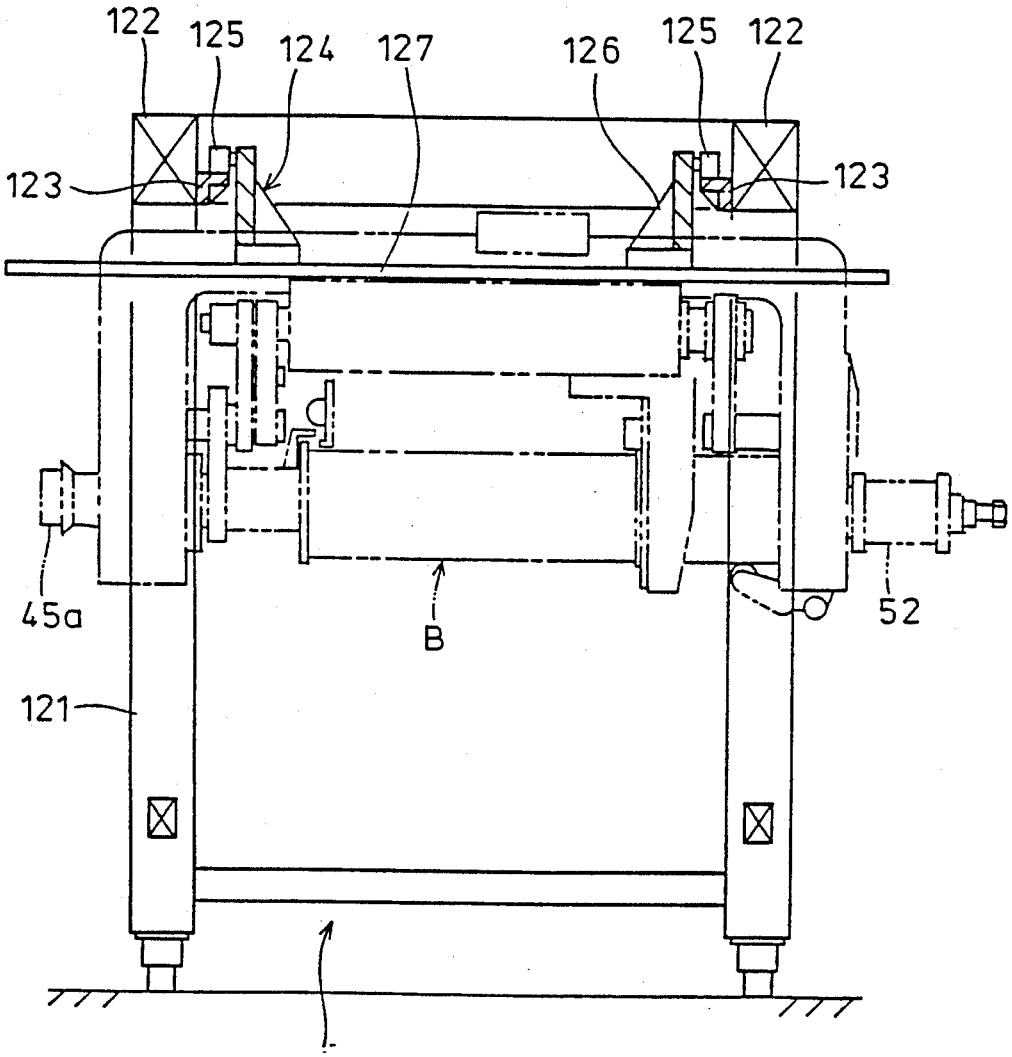
Figure 16:
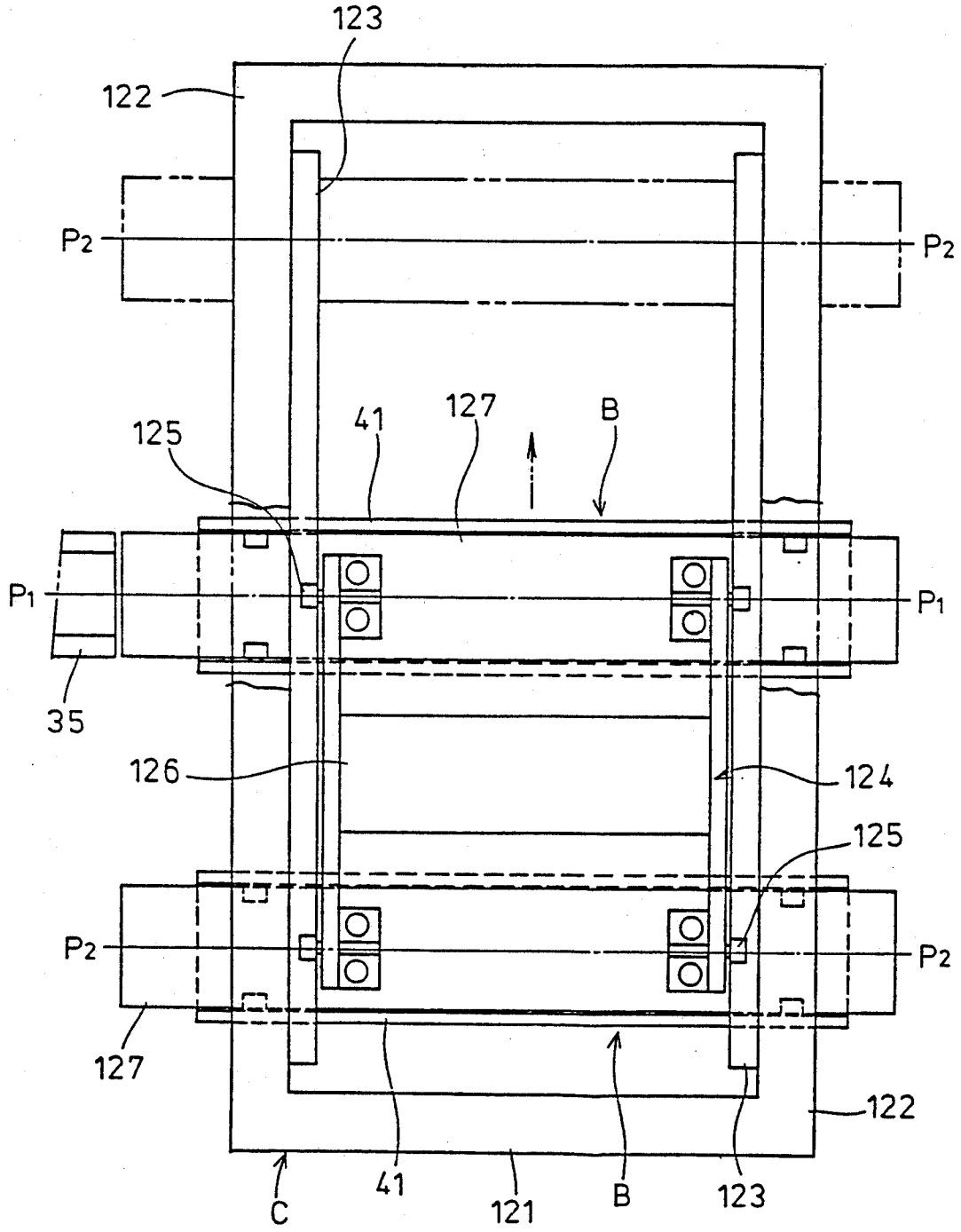

On the other hand, the replacing station C to be provided to oppose the forming machine A is adjacent to the outside of the open end of the forming machine 1 as a station for replacing the forming device, and as shown in FIGS. 15 and 16, a pair of rails 123 extend parallel with each other in the longitudinal direction along the inside of the upper horizontal bars 122 provided on both sides of a frame stand 121 and perpendicular to the plane of the guide rail 35. A carriage 124 is disposed between the rails 123. The carriage 124 is intended for holding more than one forming devices B which are waiting there to be used in the following order, and as shown in the Figures, two rail plates 127 which can hold the forming device B being suspended therefrom are disposed on the movable frame 126 placed on and between the rails 123 through wheels 125, parallel with the guide rail 35. Said carriage 124 can be moved in the direction which is perpendicular to the plane of the rails 123 (vertical direction in FIG. 16) such that each rail plate 127 may stop at a replacement position $P_1$ at which said rail plate 127 is in alignment with the rail 35 or in/out position $P_2$ at which the former is spaced from the rail 35. It should be noted that both sides of the frame stand 121 are not closed. Each of the rail plates 127 of the carriage 124 is formed into an elongated flat plate having the same width as that of the guide rail 35 and a length suitably longer than that of the holder 41 of the forming device B, and both ends of said plates 127 are extended in a suitable length from the open side of said frame stand 121 on each side in the form of eaves. It should be noted that in the replacing station C, it is also possible to provide a crawler means (wheel) in the frame stand 121 and a guiding means (rail) in the carriage 124.

Figure 1:
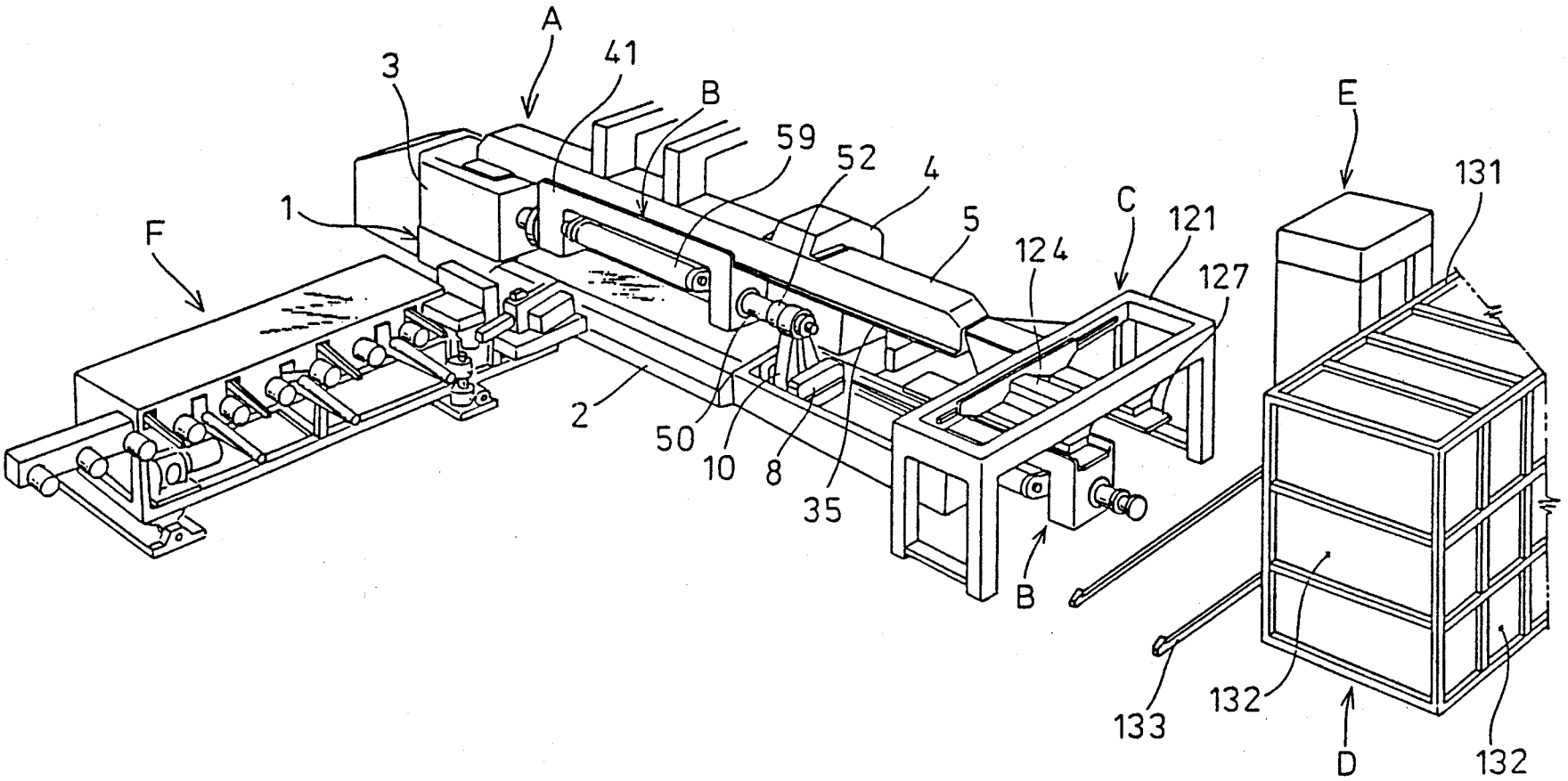

The storage D to be provided for the forming machine B, as shown schematically in FIG. 1, is adopted to be capable of storing various types of forming devices B to be received in pigeonholes 132 defined in a rack 131, respectively. It is desirable that each pigeonhole 132 is identified with an identification number or the like. Between said replacing station C and the storage D, disposed is a conveyer E capable of traveling along rails 133. Thus, each forming device B is designed to be replaced by means of a replacing device (not shown) in this conveyer E between each pigeonhole 132 and each rail plate 127 provided on said carriage 124. It should be noted that the conveyer E is adopted to be capable of crawling on the basis of remote control operation and shifting vertically to the level to oppose to each pigeonhole 132 (see FIG. 1).

Figure 21:
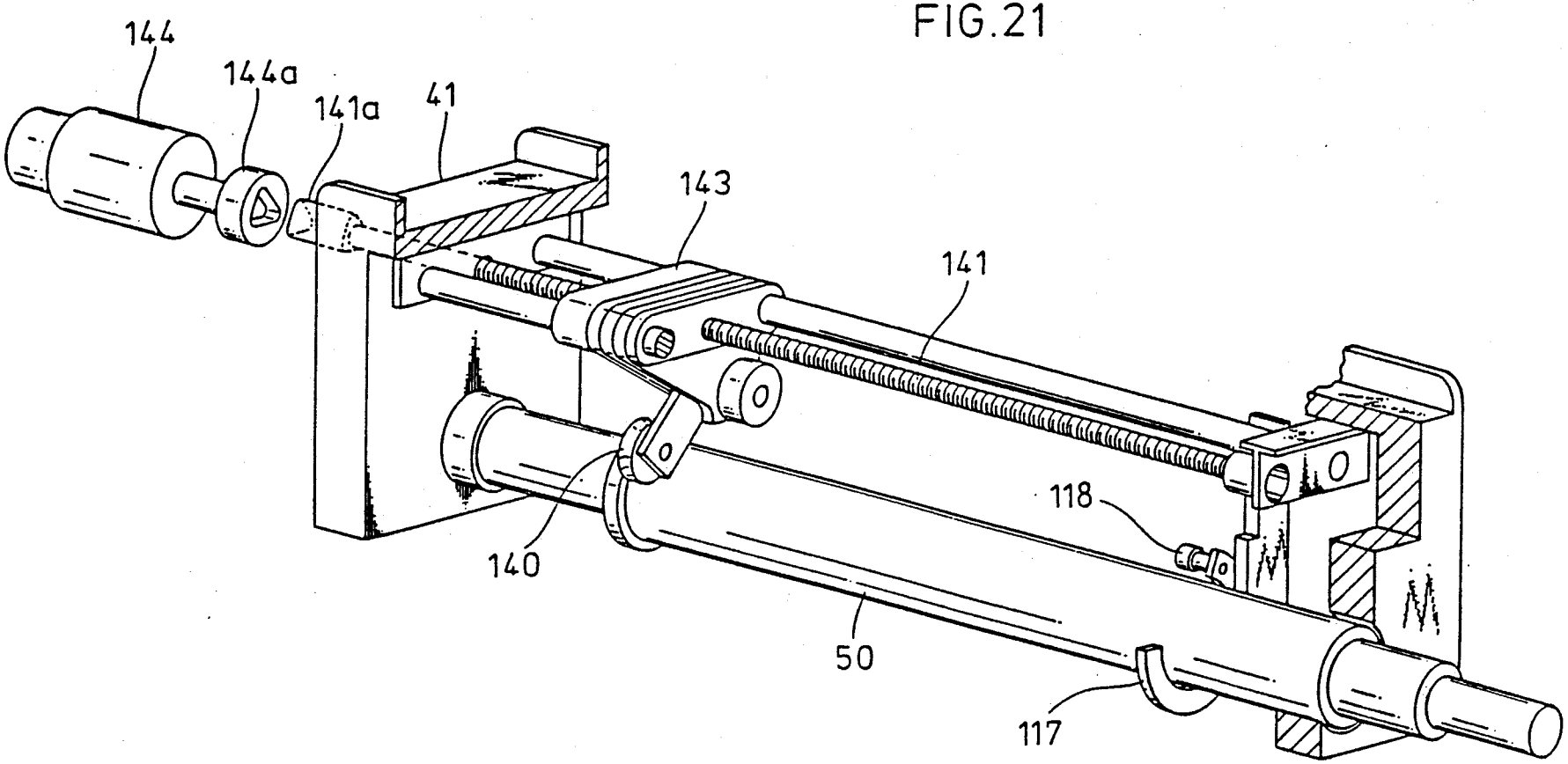
FIG. 21 shows another embodiment of a cassette mechanism to be used according to this invention.

FIG. 21 shows another embodiment of the cassette mechanism according to this invention, wherein the mandrel 50 is rotatably supported in the holder 41, and a guide roller 140 as a guide means for allowing the rod or wire-shaped spring material to be wound around the peripheral surface of the mandrel 50 into a form of spiral is also disposed, said roller being movable horizontally in the axial direction of said mandrel 50. To describe in detail, a feed screw 141 is disposed in the holder 41 to be parallel with the mandrel 50, and said feed screw 141 is screwed into a head 143 carrying said guide roller 140. One end of the feed screw 141 protrudes outward the holder 41 such that a male coupling 141*a* fixed to the protruded end of said feed screw 141 is removably combined with a female coupling 144*a* fixed to the rotary shaft of a servo motor 144 as shown in FIG. 21. The mandrel 50 is also connected to the machine body 1 by means of a coupling mechanism described above to provide main driving force to said mandrel 50.

When a coil spring is formed by means of the cassette mechanism shown in FIG. 21, the end of the spring material fed is held tightly between the peripheral surface of the mandrel 50 and the guide roller 140, and then simultaneous with the starting of rotation of said mandrel 50, the servo motor 144 is rotated at an appropriate speed which can provide the required lead angle for the spring. Thus, said head 143 carrying the guide roller 140 is forwarded, as the feed screw 141 rotates, in the axial direction parallel with the mandrel 50 at a required speed, whereby the spring material is formed into a coil spring with the required pitch.

Next, an example of replacing the cassette type forming device will be explained. To describe in detail, when the device B is to be carried from the replacing station C into the forming machine A to be set therein, the carriage 124 in the replacing station C is moved to bring one rail plate 127 to be in alignment with the replacement position $P_1$ relative to the guide rail 35 of the forming machine A as shown in FIGS. 15 and 16; whereas the entire traveling pedestal 8 in the forming machine A is moved to the right end of the base 2 along the rails 7 as shown in FIGS. 2 and 3, in accordance with the advancing motion of the operating cylinder 12 in the carriage device 6, and also the two bearing arms 10 are allowed to wait in an open posture upon actuation of the closing cylinder 14.

In such a state, the entire forming device B carried by the rail plate 127 of the carriage 124 within the replacing station C is moved toward the forming machine A to the required position at the free end of the guide rail 35 from said rail plate 127 (see FIG. 17*a*). Next, the closing cylinder 14 is actuated to close said two bearing arms 10, whereby the shaft support member 52 of the mandrel 50 in the forming device B is embraced between the bearing portions 11.

As the traveling pedestal 8 is pulled along the rails 7 to be moved to the left by the retracting motion of said operating cylinder 12, the forming device B is pushed back by the traveling pedestal 8 to be moved along the guide rail 35 toward the left end of the machine body 1. With the left end of the rotary shaft 45 in the forming device B being at a position adjacent to the right end of the rotary main shaft 22 in the drive operation device 17, the two couplings 22*a* and 45*a* are aligned with each other for the fitting position and orientation, and then the two shafts 22 and 45 are combined, whereby a proper position for the mandrel 50 to be connected to the drive operation device 17 can be determined. It should be noted that in positioning and connection of the two shafts 22 and 45, said cylinder 12 can be stopped once to stop the traveling pedestal 8.

Figure 17:
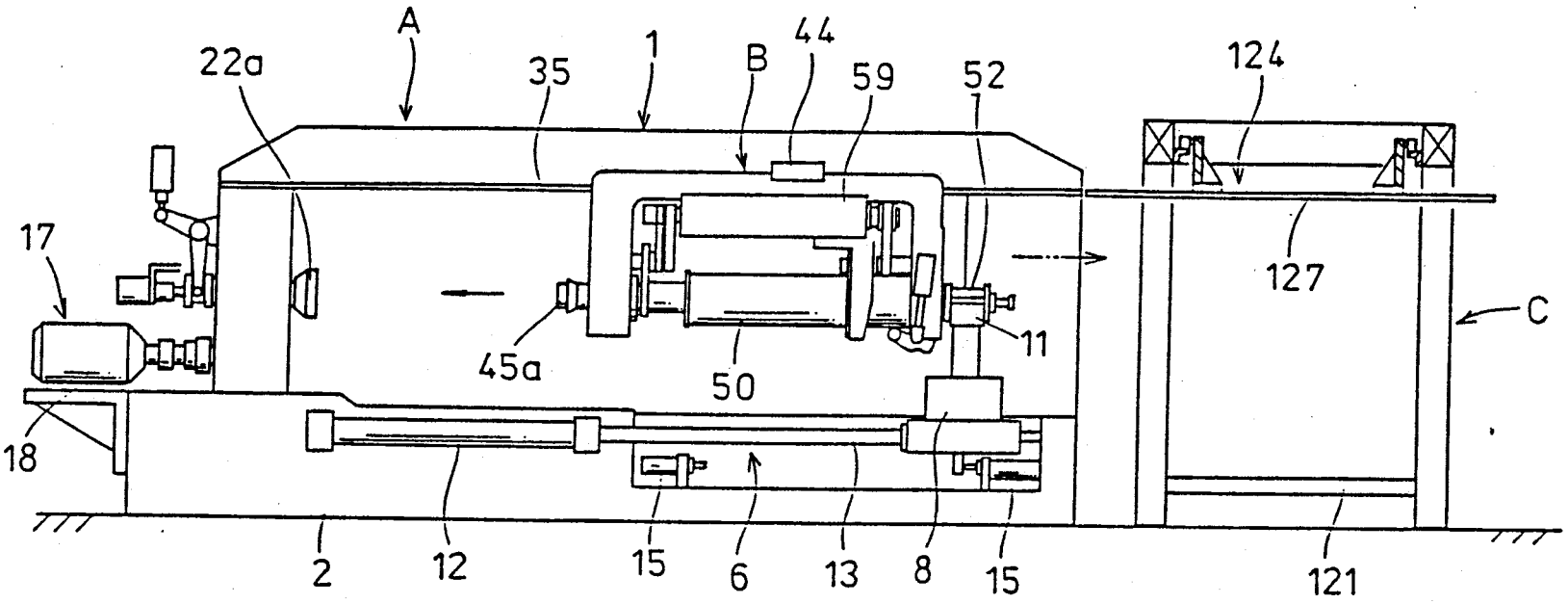
Figure 17:
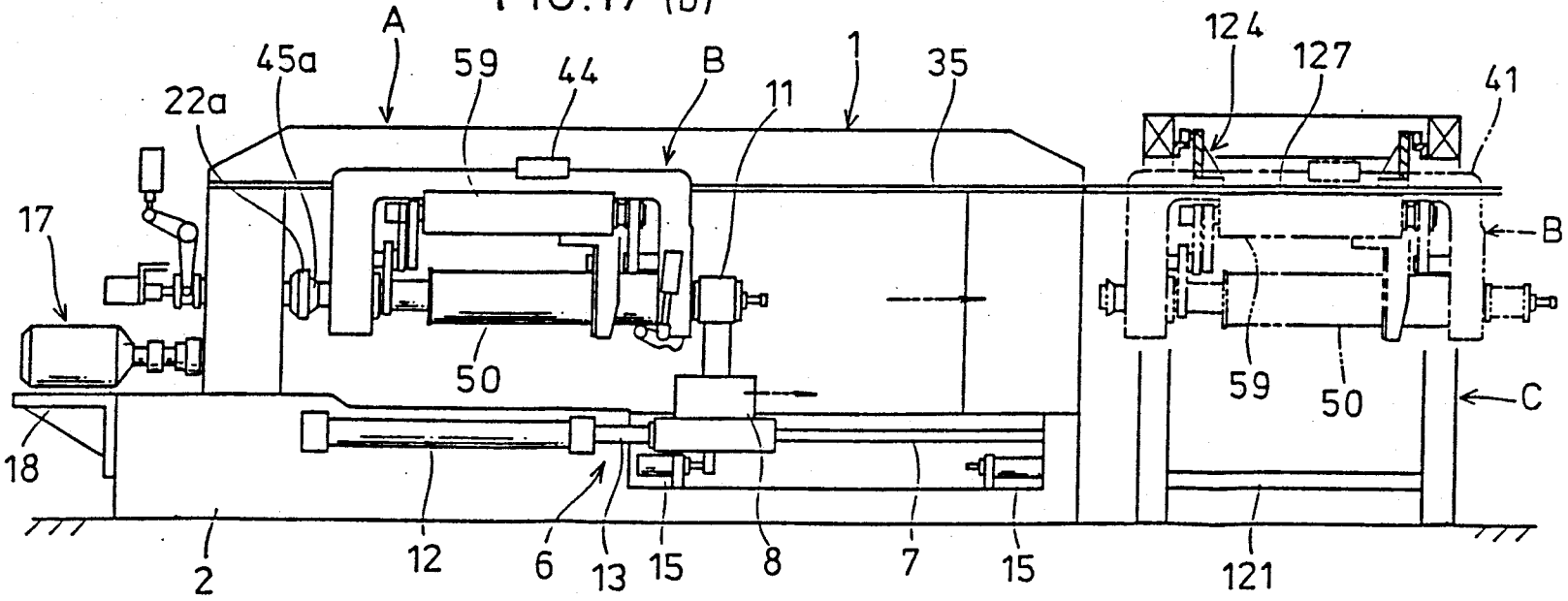

Subsequently, by fixing the holder 41 to the guide rail 35 by means of a clamp 44 and by stopping said traveling pedestal 8 at a predetermined position to achieve positioning of the shaft support member 52 of the mandrel 50 to allow the two bearing arms 10 to hold said member 52, said forming device B is set at a proper position relative to the forming machine A and retained there, where it can be used for the operation of spring forming (see FIG. 17(*b*)).

When the forming device B having been set in the forming machine A is to be carried out, the process of carrying in the forming device B mentioned above can be repeated in the reversed order. Namely, in the stationary state of the forming device B, the clamp 44 is first unclamped to release the holder 41 relative to the guide rail 35, and then the operating cylinder 12 of the carriage device 6 is operated for advancing motion. Thus, the traveling pedestal 8 is carried with the shaft support member 52 of the mandrel 50 being supported by the two bearing arms 10, while the holder 41 follows to move to the right, whereby the rotary support shaft 45 is separated from said rotary main shaft 22. As a result, the entire forming device B is moved to the right in a posture that it is suspended from the guide rail 35 (see FIG. 17(*a*)).

With said traveling pedestal 8 stopped at the foremost advanced end at the right end of the base 2, the both bearing arms 10 are opened once by actuating the closing cylinder 14 to release the shaft support member 52 of the mandrel 50. Subsequently, the forming device B is transferred from the guide rail 35 to said rail plate 127 of the carriage 124 in the replacing station C, and thus the operation of carrying out the forming device B is completed (see FIG. 17(*b*)).

Next, detailed description will be made on an example of forming a spring utilizing the forming device B having been set at a predetermined position in the forming machine A. Namely, the spring is formed basically in the same manner as in the prior arts, wherein the starting end of the spring material W to be fed from the feeding machine F shown schematically in FIG. 1 is regulated and guided by the regulating bar 109 of the starting end regulating device 105 in the forming device B to be positioned in the starting end of the lead groove 60 of the lead screw 59 and inserted therein and also abutted against the starting end portion on the peripheral surface of the mandrel 50.

The operating cylinder 25 in the drive operation device 17 of the forming machine A is then actuated to advance the operating rod 28, and the chucking piece 103 is closed by operating the actuaging bar 98 of the chucking device 97 to effect chucking of the starting end of said spring material. Subsequently, as the motor 18 in the drive-operation device 17 is started, the rotary support shaft 45 is rotated together with the mandrel 50 through the drive shaft 20 and rotary main shaft 22, and the lead screw 59 is also rotated through the rotation transmitting mechanism 71, whereby the winding operation of the spring material W, i.e. formation of spring, will be started and can be continued thereafter.

In the final step of the forming operation, i.e. in the formation of spring seat, the tail end portion of the spring material W, to be released from the lead groove 60 at the terminal end of the lead screw 59, is pushed by the pressing member 118 of the tail end regulating device 115 against the mandrel 50 to be fitted along the peripheral surface of said mandrel 50, and the position of the last wind end of the material, i.e. the spring seat end is regulated by the regulating board 117. Said spring can thus be formed into a predetermined desired length.

The spring $W_1$ thus formed can be removed with the separation of the mandrel. To described in detail, the set screw 78 is loosened to release the linkage between the rotary support shaft 45 and the mandrel 50, and also the operating cylinder 25 is actuated for retracting motion to allow the chucking piece 103 of the chucking device 97 to assume the open posture, whereby the starting end of the spring $W_1$ on the mandrel 50 is released. In this state, the operating cylinder 12 of the carriage device 6 in the forming machine A is actuated for advancing motion to move the traveling pedestal 8 to the right end of the base 2. With the above operation, the mandrel 50 is separated from the rotary support shaft 45, and with the shaft support member 52 being retained by the both bearing arms 10, said mandrel 50 is pulled out to a predetermined position through the insertion opening 49 of the holder 41 by being guided by the roller 85 of the guide support device 81. During this process, the spring $W_1$ around the peripheral surface of the mandrel 50 is removed therefrom in a posture that it is in engagement with the regulating board 117 of the tail end regulating device 115 relative to the movement of the mandrel 50, and then dropped from the rear side of the forming machine A.

After removal of the spring, said mandrel 50 is advanced toward the rotary support shaft 45 as the traveling pedestal 8 is moved in accordance with the retracting motion of said cylinder 12. The engaging boss 51 of the mandrel 50 is then fitted into the engagement hole 47, and tightened again with the set screw 78, whereby the mandrel 50 is connected at a proper position relative to the rotary support shaft 45 to be ready for the next cycle of spring forming.

In the forming device of this embodiment to be practiced as described heretofore, partial replacement and adjustment in accordance with the changes in the requirements in forming springs are possible, while said device is set in the forming device A, and examples of such replacement and adjustment will be described below independently. First, when the diameter or the length of the spring is to be changed, the mandrel 50 is removed from the holder 41 with the travel of the traveling pedestal 8 by operating the carriage device 6 after the linkage with the rotary support shaft is released, and then it is replaced with a required new mandrel 50 of a different type, which is then supported by said bearing arms 10 of the traveling pedestal 8, inserted into the holder 41, positioned against said rotary support shaft 45 and connected thereto to complete the setting of the mandrel 50. Following the above procedure, in the starting end regulating device 105, the regulating bar 109 is adjusted to a position to be in contact with the peripheral surface of the new mandrel 50; whereas in the tail end regulating device 115, the regulating board 117 and pressing member 118 are replaced with those of different types, respectively, and are set at respective predetermined positions along the axial direction of the new mandrel 50 and the lead screw 59 in accordance with the shift of the movable support bar 116. Further, in the adjusting device 92, while the bolt 96 is turned to allow the support arms 56 in the holder 41 to be pivoted, the lead screw 59 is set at a suitable position and with a suitable distance relative to the new mandrel 50.

On the other hand, when the wire thickness or spring pitch of the material W are to be changed, the covering pieces **58*b* of the bearing portions 58 in the bearing arms 56 on both sides of the holder 41 are once removed, and the lead screw 59 is replaced with another predetermined one of a different type having a suitable size of lead groove 60 (depth and width) and pitch, to be supported again between the bearing arms 56. Following the above procedure, the bolt 96 in said adjusting device 92 is handled as desired, and a new lead screw 59 is set at a suitable position relative to the mandrel 50. In the above procedure, the pressing member 118 in said tail end regulating device 115** can be replaced with another of a different type or the position thereof may be changed.

When only the length of the spring is to be changed, the regulating board 117 and the pressing member 118 in the tail end regulating device 115 can be set at suitable positions relative to the mandrel 50 and the lead screw 59, respectively. In the above procedure, if the position of the pressing member 118 must be adjusted, it can be set at a predetermined position along said regulating board 117.

Figure 18:
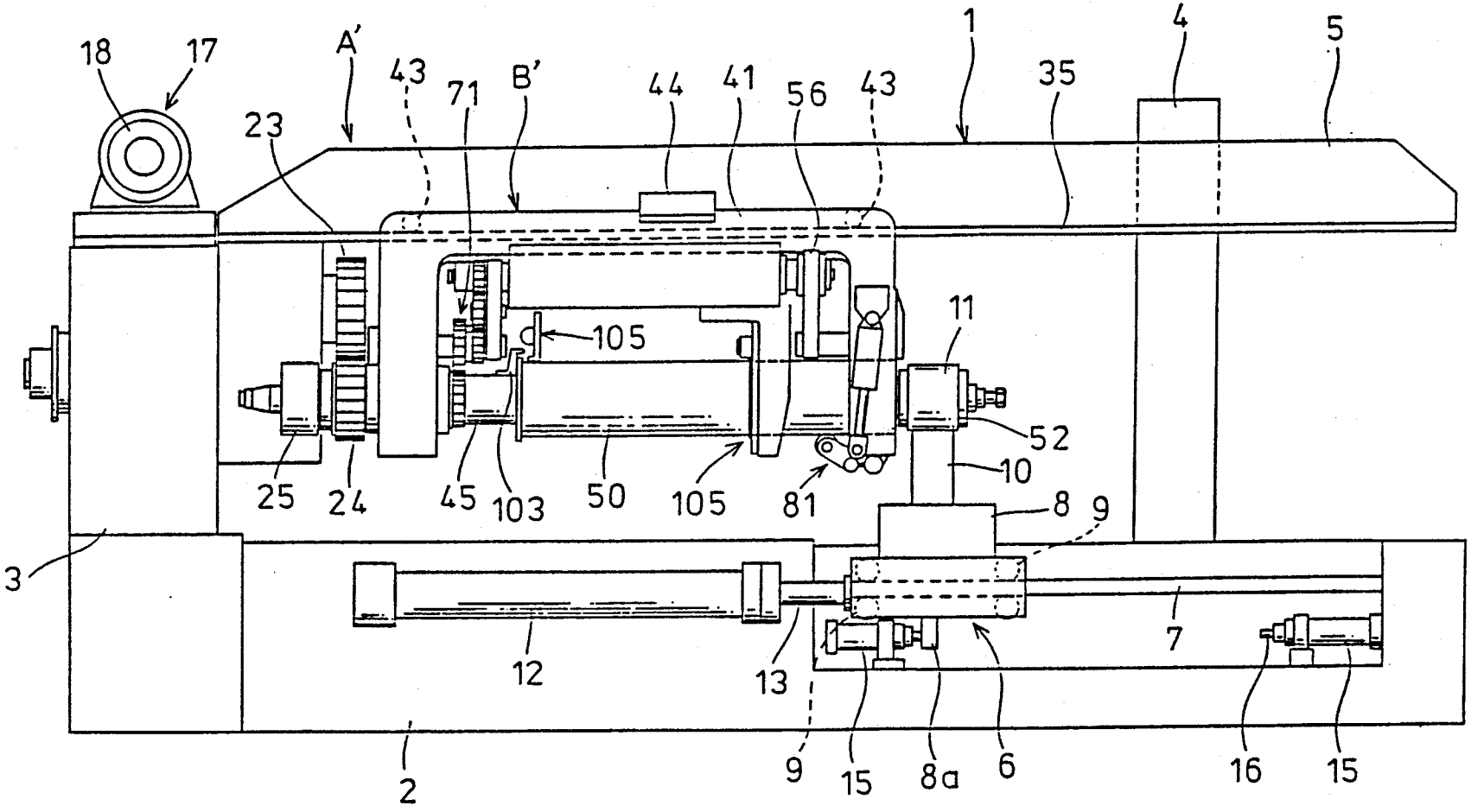
Figure 19:
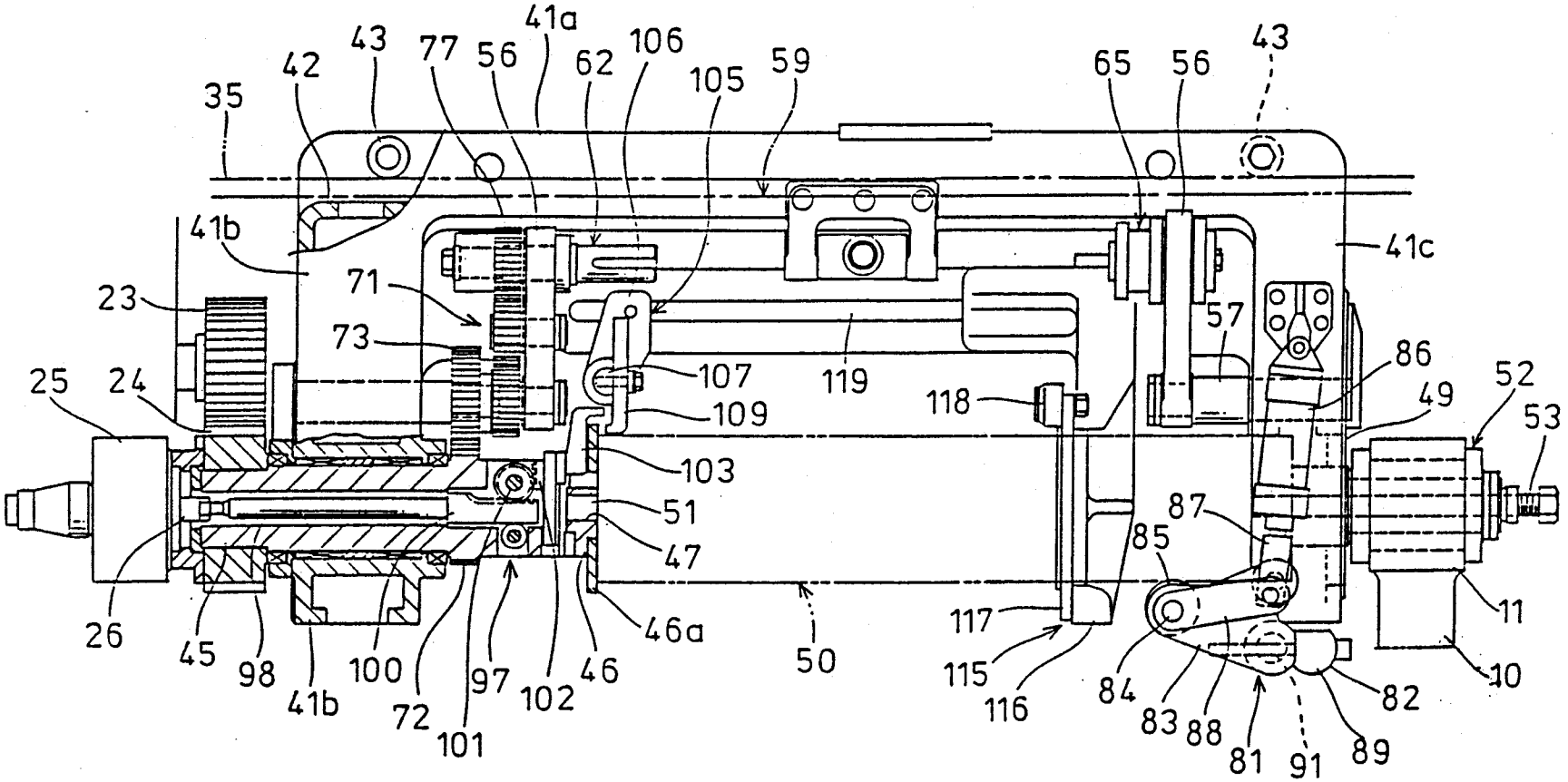
Figure 20:
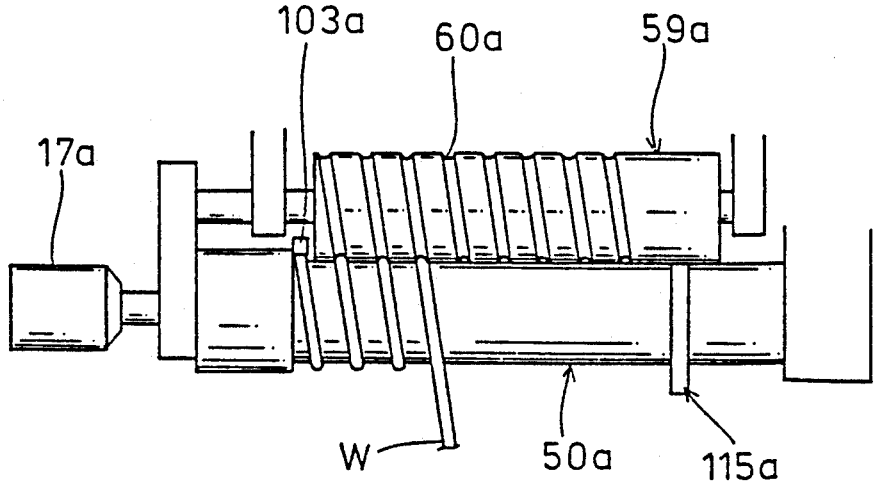
FIG. 20 is an illustration showing schematically a basic embodiment for wind-forming a spring.

In the forming device which is one of the objects of this invention, while various forming devices are provided depending on the applications and sizes, different types of forming devices which are conformable to the type of the forming machine, in which said forming device is practiced, can also be provided. For example, in the forming machine A' as shown schematically in FIG. 18, the forming device B' as shown in FIG. 19 can be practiced. To describe first the forming machine A' in comparison with the aforementioned forming machine A, the driving device 17 is provided by the frame 3 of the machine body 1, and a rotation system utilizing a series of gears are formed relative to the motor 18 in the driving device 17 such that said system may be separably connected to the rotary support shaft 45 in the forming device B' to be described later. The constitutions of the remaining portions are the same as those of the aforementioned forming machine A, wherein the equivalent portions are represented by the same numerals for which detailed description will be omitted.

On the other hand, in the forming device B' in the above embodiment, when compared with the forming device B, the rotation system of the rotary support shaft 45 and the operation system of the chucking device 97 provided within said support shaft 45 are each formed into an independent constitution. To describe in detail, the gear 24 fitted to the outer end (left end in the Figure) of said rotary support shaft 45 rotatably supported horizontally through the left side arm **41*b* of the holder 41 is adopted to be engaged with the gear 23 in the driving device 17 in the forming machine A'; whereas in the chucking device 97, which comprises the same essential constituents as those of the chucking device 97 according to the foregoing embodiment, the actuating rod 98 for operating the chucking piece 103 is directly connected to the rod 26 of the operating cylinder 25 disposed outside of the left end of the rotary support shaft 45, and the actuating rod 98 is pushed or pulled in accordance with the reciprocating motion of the cylinder 25 such that the chucking piece 103 may be shiftable outwardly in the radial direction of the mandrel 50 through the rack 100, pinion 101 and rack 102**. The constitutions of the remaining portions in the forming device B' are the same as those of the aforementioned forming device B and each member, device, etc. are disposed likewise, wherein the equivalent portions are represented by the same numerals for which detailed description will be omitted.

Replacement of such forming devices B' can be carried out by carrying in a forming device B' into the machine body 1 by use of the replacing station C, guide rail 35 in the forming machine A'; and the carriage device 6, and then the holder 41 is fixed to the machine body 1 by means of a clamp 44 at a position where the gear 24 in the rotary support shaft 45 is in proper engagement with the gear 23 in the drive operation device 17, to allow the entire forming device B' to be set therein, in the same manner as in the above embodiment. After the clamp 44 is unclamped to release the fixing of the holder 41 relative to the machine body 1, the entire forming device B' can be carried out of the machine body 1 along the guide rail 35 upon actuation of the carriage device 6, and then returned to the carriage 124 in the replacing station C.

On the other hand, in the forming device B', replacement of the mandrel 50 and the lead screw 59, and adjustment of the starting end regulating device 105, tail end regulating device 115, guide support device 81, etc. can be carried out in the same manner as described in the foregoing embodiment to form springs of various sizes.

VARIATION

The forming device according to this invention may of course take a form other than those described above corresponding to the constitutional changes in the forming machine. In the forming machine, for example, a constitution is possible wherein a chain to be reciprocated by a motor or other means, as a means for replacing the forming device by carrying it thereon (carriage device), can be extended along the internal side of the beam 5 in the machine body 1; also in a type of embodiment in which the pivotally supported bearing arms 10 which can be opened or closed are provided at a predetermined position in the base 2, a constitution is also possible wherein an engaging means which is engageable with a connecting means or the like provided with respect to said chain can be disposed in the forming device at an appropriate position in the holder 41 such that the entire forming device may be movable along the guide rail 35 of the machine body 1 by means of the chain through the wheels 43 of the holder 41; whereas in the holder 41, one end of the predetermined mandrel 50 to be inserted to the holder 41 can be positioned relative to the rotary support shaft 45 and connected thereto, and the other end thereof is positioned relative to the bearing arms 10 on the base 2 and supported thereby.

The forming device is to be constituted to be conformable depending on the applications and types, and it is of course possible to have a constitution which is conformable for forming various coil spring such as of conical, hand drum-shaped, etc., as well as, compression, tension and torsion springs. Particularly as the shape of the mandrel 50, it may not be limited to cylindrical or tubular, but a conical shape or combinations thereof may also be used.

It can be appreciated from the above description on the embodiments that the forming device according to this invention as a whole can be formed into an extremely convenient jig unit, since it can be handled as a replaceable cassette comprising a holder which is movable in suspension relative to the rail member in the body of the forming machine in which said forming device is to be practiced, wherein the major section which is conformable for forming various sizes of springs, i.e. a mandrel and a lead screw each of predetermined sizes, rotation transmitting mechanism, chucking device, tail end regulating device and other necessary auxiliary devices or means which are positioned and disposed relative to each other. Also, in the respective devices, the major sections which are conformable for forming various sizes of springs can be preliminarily adjusted accurately and properly, and stored until they are used.

Since a forming device according to this invention can be selected corresponding to the requirements for forming a spring and practiced in the forming machine, and can be carried into the forming machine or carried out therefrom for replacement in accordance with the changes in the requirements for forming springs and changes in the lot of springs to be produced, to be set easily at a predetermined position in the machine body, a set of spring forming equipment can be formed of a various types of required forming devices relative to one forming machine which can be used in common, whereby the operability and universality, particularly forming capacity can be improved notably.

According to said forming device, since the main forming section is accurately formed preliminarily based on the requirements and data for forming springs, great changes or adjustment and complicated preparation will be all unnecessary once the forming device is set at a predetermined position in the forming machine, whereby what is required in practicing said forming device will merely be minimal fine adjustment, confirmative inspection and trial winding and the like. Thus the forming machine can be operated speedily and property to exhibit excellent performance.

In the other embodiment of the forming device which can correspond with changes in the size of the spring, the mandrel to be inserted horizontally through said holder is designed to be removably supported between said rotary support shaft member and said bearing member in the machine body to be replaceable with those having different diameters; the lead screw to be provided relative to the mandrel is removably supported between the supporting members pivotally disposed at both end portions in the holder to be replaceable with those of various sizes such as of different diameters and lead grooves, and also the position of said lead screw is designed to be adjustable relative to the mandrel by use of the adjusting device provided between the support member and the holder; the regulating member in said tail end regulating device is designed to be replaceable with those having sizes which is conformable to the mandrels of different diameters and also to be shiftable in the axial direction of the mandrel; and the roller support member for receiving the lower peripheral surface of the mandrel in the guide support device provided in one end of said holder is designed to be shiftable in the radial direction of the mandrel, whereby the major section for forming the spring in the forming device can be recombined or reconstituted with those of the required sizes for formation.

According to the present forming device, in the case where the type of the spring is the same but the size thereof is to be changed to be smaller or larger, the entire forming device need not be carried out for replacement, but the mandrel and the lead screw can be replaced with those of different sizes and the respective devices can be adjusted while the forming machine is under practice within the forming machine, to recombine speedily and accurately the major section for forming the spring which is conformable to various sizes, and also to recombine again to the original combination.

Particularly in the present forming device, if one holder is used in common for a plurality of mandrels, lead screws and regulating members for the tail end regulating devices, each of different sizes, forming devices for forming various sizes of springs can be recombined and reconstituted freely. Thus, the range of forming capacity and universality of a single forming device can be enhanced, and said forming device can be practiced suitably and efficiently for forming springs which may frequently be produced.

In the other replacement method according to this invention, the forming device is carried out for replacement with another, between said forming device and the replacing station to be disposed adjacent to the outside of the open free end of the rail member in said forming machine, corresponding to the changes in requirements for forming the spring and in the lot of spring to be produced; wherein the forming devices which are conformable for forming various springs are selected and preliminarily set on the supporting member of the carriage within the replacing station and supported thereby, the supporting member of the carriage is then brought in alignment with the free end of said rail member to transfer the forming device from the carriage to said rail member, and the forming device is carried to a predetermined position in the body of the forming machine along the rail member by use of the traveling member in said carriage in the forming machine.

Subsequently, while the rotary member in the forming device is connected to the rotation system of the driving device of the forming machine, the mandrel within the forming device is allowed to be rotatably supported by the bearing member in the base of the forming machine, and also the holder of the forming device is fixed to the body of the forming machine.

Based on a series of the operations as described above, the desired forming device can be carried in to be set in the forming machine, and based on the reversed order of the above operations, i.e. in the order of unclamping of the holder, separation of the two members in the rotary system, separation of the mandrel and carrying of the forming device, the forming device can be carried out of the forming machine to be returned to the carriage in the replacing station.

Therefore, according to the replacement method of this invention, since the operation and procedures for replacing said device is patterned either in carrying in or carrying out step, operations can be simplified greatly for saving labor and trouble so that an untrained operator can handle it speedily and accurately. Since the means required for the replacement of the forming device is almost limited to the rail member or carriage device provided in the forming machine, neither a large-scale apparatus nor many operators will be necessary. Thus, a small number of operators can perform the replacing operation safely and speedily, and also a wide space for carrying out the replacement will not be necessary.

Particularly in the replacement of the forming device, since it can be carried out very speedily, the period of suspension of the operation of the forming machine and the feeding machine for feeding the spring material can be shortened to avoid reduction in the efficiency in the entire spring forming equipment, and also the fuel consumption in the heating furnace for heating the spring material can be minimized advantageously.

I claim:

1. A cassette type coil spring forming device to be practiced replaceably in the body of the forming machine for forming a coil spring by winding a heated rod or wire-shaped spring material into a form of spiral, comprising, a means for forming a major section of a spring in a holder which can be moved along a rail member extended longitudinally in said body such that said holder may be carried in or out of said body, and also can be fixed releaseably thereto;

a rotary shaft member to be rotatably supported horizontally in one arm of said holder and to be separably connected to a rotation system in a driving device provided in said body;

an insertion opening for inserting a mandrel therethrough, formed in the other arm of said holder, which opening is in alignment with and opposed to said rotary shaft member;

a mandrel for winding said material therearound, to be inserted through said insertion opening, wherein one end thereof is to be positioned relative to the inner end portion of said rotary shaft member and linked thereto, and the other end is to be rotatably supported to be separable relative to a bearing member disposed in said body;

a lead screw for guiding said material, to be set at a predetermined position relative to said mandrel by being rotatably supported horizontally between support members provided in said holder at both end portions, and also to be connected to said rotary shaft member through a rotation transmitting mechanism;

a chucking device for securing said material, wherein a chucking piece incorporated at the inner end portion of said rotary shaft member is connected to an operation section provided at an outer end portion of said member through an operation member, whereby the starting end of said spring material is secured at a peripheral starting end portion of said mandrel;

and a tail end regulating device for regulating a wind terminal end of the spring material by positioning or guiding a tail end portion of said spring material to be wound around the mandrel at a predetermined position of said mandrel along the axial direction of said mandrel.

2. A cassette type coil spring forming device which is replaceably secured in a body of a forming machine for forming a coil spring by winding a heated rod or wire-shaped spring material into a form of spiral, comprising, a means for forming a major section of a spring in a holder which can be moved along a rail member extended longitudinally in said body such that said holder may be carried in or out of said body, and also can be fixed releaseably thereto;

a rotary shaft member to be rotatably supported horizontally in one arm of said holder and to be separably connected to a rotation system in a driving device provided in said body;

an insertion opening for inserting a mandrel therethrough, formed in the other arm of said holder, which opening is in alignment with and opposed to said rotary shaft member;

a mandrel for winding said material therearound, to be inserted through said insertion opening, wherein one end thereof is to be positioned relative to an inner end portion of said rotary shaft member and linked thereto, and the other end is to be rotatably supported and separable relative to a bearing member disposed in said body; said mandrel being replaceable with those having predetermined sizes;

a lead screw for guiding said material, to be set at a predetermined position relative to said mandrel by being rotatably and separably supported horizontally between a bearing in support members pivotally provided in said holder at both end portions, and also to be connected to said rotary shaft member through a rotation transmitting mechanism, wherein said lead screw being replaceable with those having predetermined sizes;

a chucking device for securing said material, wherein a chucking piece incorporated at the inner end portion of said rotary shaft member is connected to an operation section provided at an outer end portion of said member through an operation member, whereby a starting end of said spring material is secured at a peripheral starting end portion of said mandrel;

a tail end regulating device wherein a regulating member for positioning and regulating a wind terminal end of the spring material to be wound around the mandrel is adopted to be removable and replaceable with one having a diameter which conforms to that of mandrel, said tail end regulating device being shiftable in an axial direction relative to the mandrel;

a guide support device for guiding and supporting the mandrel, wherein a roller support member for supporting a lower peripheral surface of said mandrel is provided to be adjustable for shifting in a diametral direction of said mandrel; and an adjusting device extended between said holder and the supporting member for supporting said lead screw, by which the position of the lead screw is adjustable relative to said mandrel.

3. A method of replacing a coil spring forming device wherein a main forming section is formed into a movable type holder, between a body of the forming machine for forming a coil spring by winding a heated rod or wire-shaped spring material into a form of spiral and a replacing station for the forming device disposed adjacent to an open side of said body; which method comprises the step of:

carrying in or carrying out the holder of a cassette mechanism by bringing the support member of a carriage device provided within said replacing station in alignment with an open free end of a rail member extending horizontally in said body and by moving suitably said holder therebetween;

fixing or unlocking the holder of said forming device at a predetermined position of said rail member;

connecting or separating a rotary shaft member disposed within the holder of said cassette mechanism with or from a rotation system of a driving device provided for said body; and allowing one end of a mandrel, provided in said holder of the cassette mechanism for winding the spring material therearound, to be supported by or separated from a bearing member disposed in said body.

* * * * *

UNITED STATES PATENT AND TRADEMARK OFFICE

CERTIFICATE OF CORRECTION

PATENT NO. : 5,144,826

DATED : September 8, 1992

INVENTOR(S) : Motoo Morita

It is certified that error appears in the above-identified patent and that said Letters Patent is hereby corrected as shown below:

On the title page,

Column [73] Assignee: Change "Morita Iron Works Co., Ltd." to -- Morita and Company Co., Ltd.--

Signed and Sealed this

Twenty-third Day of November, 1993

*Attest:*

*Attesting Officer*

Bruce Lehman

BRUCE LEHMAN

*Commissioner of Patents and Trademarks*